US009367994B2

(12) United States Patent
Guase et al.

(10) Patent No.: US 9,367,994 B2
(45) Date of Patent: Jun. 14, 2016

(54) SOCIAL COLLABORATION IN COMMUNITY CASINO GAME OFFERED AS PLAYER INCENTIVE

(71) Applicants: Josh Guase, Austin, TX (US); Nimai Malle, Austin, TX (US); Nathan Ratcliffe, Austin, TX (US)

(72) Inventors: Josh Guase, Austin, TX (US); Nimai Malle, Austin, TX (US); Nathan Ratcliffe, Austin, TX (US)

(73) Assignee: Zynga Inc., San Francisco, CA (US)

( * ) Notice: Subject to any disclaimer, the term of this patent is extended or adjusted under 35 U.S.C. 154(b) by 625 days.

(21) Appl. No.: 13/685,403

(22) Filed: Nov. 26, 2012

(65) Prior Publication Data

US 2014/0148230 A1 May 29, 2014

(51) Int. Cl.

| | |
|---|---|
| ***A63F 9/24*** | (2006.01) |
| ***G07F 17/32*** | (2006.01) |
| *G07F 17/34* | (2006.01) |

(52) U.S. Cl.

CPC ..... *G07F 17/3258* (2013.01); *G07F 17/323* (2013.01); *G07F 17/3267* (2013.01); *G07F 17/3274* (2013.01); *G07F 17/3213* (2013.01); *G07F 17/3241* (2013.01); *G07F 17/34* (2013.01)

(58) Field of Classification Search

CPC ... G07F 17/34; G07F 17/326; G07F 17/3286; G07F 17/3258; G07F 17/3274; G07F 17/3267; A63F 13/12; A63F 2300/65

See application file for complete search history.

(56) References Cited

U.S. PATENT DOCUMENTS

| | | | | |
|---|---|---|---|---|
| 2002/0055381 | A1* | 5/2002 | Tarantino | 463/20 |
| 2003/0104860 | A1* | 6/2003 | Cannon et al. | 463/25 |
| 2004/0235552 | A1* | 11/2004 | Gauselmann | 463/16 |
| 2005/0192087 | A1* | 9/2005 | Friedman et al. | 463/25 |
| 2006/0160620 | A1* | 7/2006 | Matthews et al. | 463/42 |
| 2007/0213121 | A1* | 9/2007 | Moshal et al. | 463/25 |
| 2007/0281775 | A1* | 12/2007 | Kashima | 463/20 |
| 2008/0287175 | A1* | 11/2008 | Kusuda et al. | 463/17 |
| 2009/0011822 | A1* | 1/2009 | Englman et al. | 463/25 |
| 2011/0070940 | A1* | 3/2011 | Jaffe et al. | 463/20 |

* cited by examiner

*Primary Examiner* — Justin Myhr
(74) *Attorney, Agent, or Firm* — Martine Penilla Group, LLP

(57) ABSTRACT

Methods, systems, and computer programs are presented for enhancing social collaboration in an online casino game. One method includes an operation for receiving bets from players playing in a first gambling mode in an online gambling room. The method also includes an operation for determining contributions to a community metric based on the outcomes of the bets, where all players in the online gambling room contribute towards the community metric. After detecting that the community metric reaches a predetermined goal, the online casino game enters all players in the online gambling room into a second gambling mode to achieve a room goal, where the value of the community metric does not change while players are in the second gambling mode.

26 Claims, 14 Drawing Sheets

SOCIAL COLLABORATION IN COMMUNITY CASINO GAME OFFERED AS PLAYER INCENTIVE

CROSS REFERENCE TO RELATED APPLICATIONS

This application is related by subject matter to U.S. patent application Ser. No. 13/685,378, filed Nov. 26, 2012, entitled "SLOTS-FUELED ADVENTURE", and issued on May 27, 2014 as U.S. Pat. No. 8,734,234, and to U.S. patent application Ser. No. 13/483,971, filed May 30, 2012, and entitled "VIRAL PROGRESSIVE JACKPOT," all of which are incorporated herein by reference.

BACKGROUND

1. Field of the Invention

The present embodiments relate to methods for executing a game, and more particularly, methods, systems, and computer programs for executing casino games.

2. Description of the Related Art

The popularity of casino games has extended to casino games played online. Online games such as poker, slots, blackjack, etc., are played on a computer by a large number of users. However, most of the slot games in the market are very similar to the real-life slot games that have been around for a long time, and the online slot games merely seem to copy the user interface provided by the real slot machines, without adding much to the online experience. Because of this, differentiation between game providers is small.

Additionally, social interaction in online games is appealing to many users that wish to share some of their gaming experience with other friends, or other potential friends that may be made online. But existing slots online games do not currently provide many opportunities for social interaction with other players, nor they provide gaming interactions with other players, as the game of one slots player does not relate to the game of another slots player.

It is in this context that embodiments arise.

SUMMARY

Methods, devices, systems, and computer programs are presented for enhancing social collaboration in an online casino game. It should be appreciated that the present embodiments can be implemented in numerous ways, such as a method, an apparatus, a system, a device, or a computer program on a computer readable medium. Several embodiments are described below.

In one embodiment, a method includes an operation for receiving bets from players playing in a first gambling mode in an online gambling room. The method further includes an operation for determining contributions to a community metric based on the outcomes of the bets, where all players in the online gambling room contribute towards the community metric. After detecting that the community metric reaches a predetermined goal, the online casino game enters all players in the online gambling room into a second gambling mode to achieve a room goal, where the value of the community metric does not change while players are in the second gambling mode, where operations of the method are executed by a processor.

In another embodiment, a method includes operations for receiving bets from players playing slots in a first gambling mode in an online gambling room, and for determining contributions to a community progress bar based on outcomes of the bets, where all players in the online gambling room contribute towards the community progress bar. After detecting that the community progress bar reaches a predetermined goal, all players in the online gambling room are entered into a second gambling mode to achieve a room goal, where the second gambling mode includes different slots wheels from the slots wheels in the first gambling mode. The value of the community progress bar does not change while players are in the second gambling mode.

In yet another embodiment, a server includes a processor, and a non-transitory memory in communication with the processor. The non-transitory memory includes program instructions for a game manager module operable to receive bets from players playing in a first gambling mode in an online gambling room, program instructions for a spin manager module operable to determine outcomes of the bets, and program instructions for a room manager operable to determine contributions to a community metric based on outcomes of the bets. All the players in the online gambling room contribute towards the community metric, and the room manager is further operable to detect when the community metric reaches a predetermined goal. All the players in the online gambling room enter into a second gambling mode to achieve a room goal when the predetermined goal is reached, where the value of the community metric does not change while players are in the second gambling mode.

Other aspects will become apparent from the following detailed description, taken in conjunction with the accompanying drawings.

BRIEF DESCRIPTION OF THE DRAWINGS

The embodiments may best be understood by reference to the following description taken in conjunction with the accompanying drawings.

DETAILED DESCRIPTION

The following embodiments describe a method and apparatus for executing a game. It will be apparent, that the present embodiments may be practiced without some or all of these specific details. In other instances, well known process operations have not been described in detail in order not to unnecessarily obscure the present embodiments.

Figure 1A:
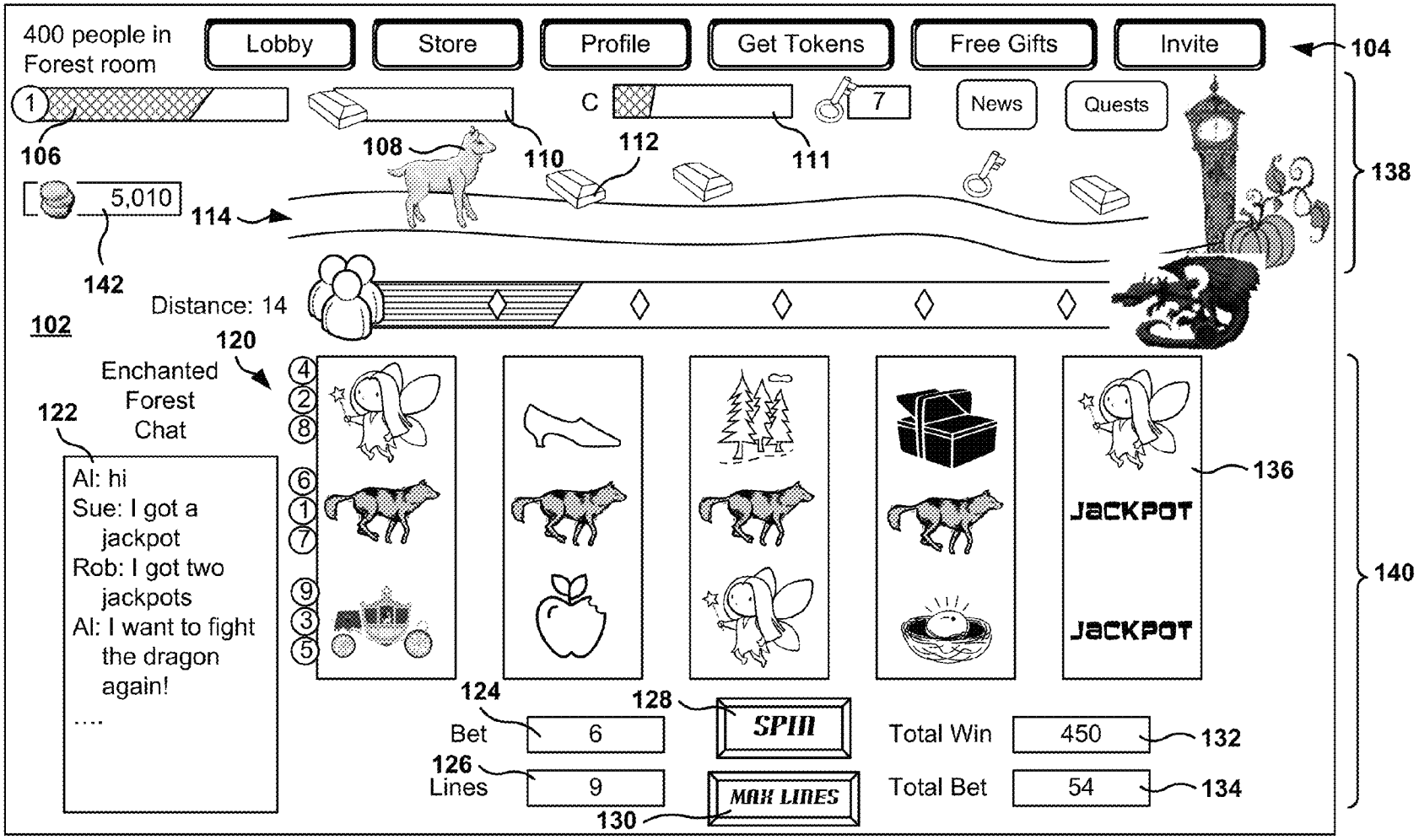
FIGS. 1A-1C present Graphical User Interfaces (GUI) for playing a slots game, according to one embodiment.
Figure 1B:
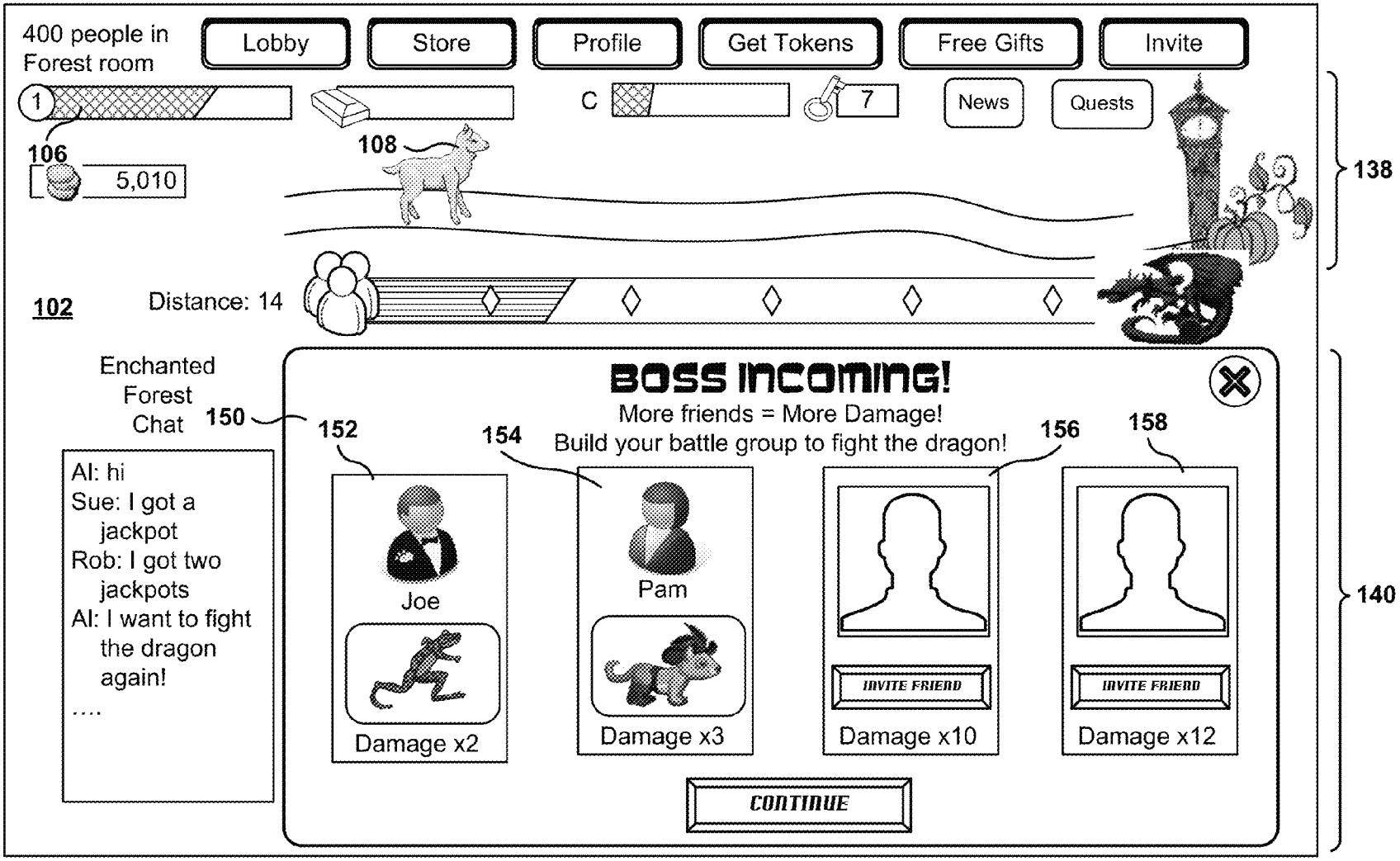
Figure 1C:
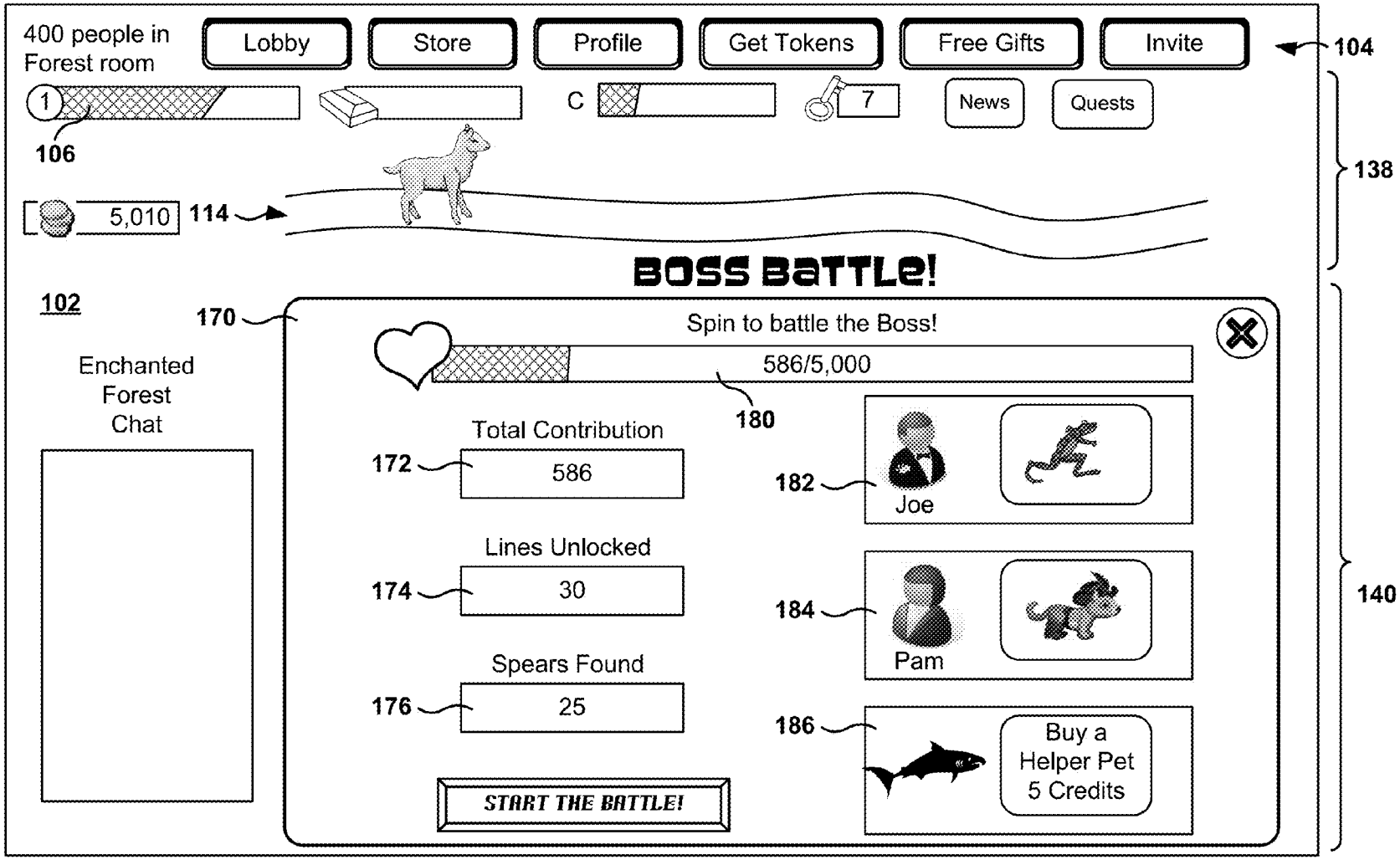

FIGS. 1A-1C present Graphical User Interfaces (GUI) for playing a slots game, according to one embodiment. As used herein, a "friend" of a player refers to a person that has established a social link with the player in the game. For example, a first player has invited a second player to be "buddies" or "friends" in the game, and the second player has accepted, which makes them "friends" in the game. In other embodiments, the friendship in the game is established via a social network, such that friends of the player in the social network become friends of the player in the online game. It is noted that although two persons may be friends in real life, if the two persons have not established a friendship relationship online, they will not be considered friends in the online game. Of course, if two persons do not know each other in real life, and they do not have an online friendship relationship, the two persons will not be friends in the game.

It is also noted that the embodiments described herein are described with reference to the slots online game, but the principles may be utilized in other gambling online games, as well as in real-life gambling games. The embodiments described herein should therefore not be interpreted to be exclusive or limiting, but rather exemplary or illustrative.

FIG. 1A is a GUI for playing the slots game, according to one embodiment. The game interface display 102 includes a slots-playing area 140, an adventure area 138, and overhead selection buttons 104. The GUI includes a lobby, where the player may select one of several rooms for playing slots games. During normal game operation, there are players going in and out of the slots rooms. The rooms have different themes, such as underwater world, desert, city, tropical paradise, battle zone, animal reserve, etc. There could be several instances of a theme room, i.e., there may be several rooms with the same theme. Once the player selects a room, the player is presented GUI 102 to play slots, such as the exemplary embodiment of FIG. 1.

The slots-playing area 140 includes slot wheels 136, a chat area 122, and buttons and counters related to the betting in the slots game. The wheels 136 spin when the player presses (e.g., clicks on) the spin button 128. The player is able to enter the amount of lines 126 to bet on each wheel spin. Each line includes a different combination of locations within each wheel. For example, one line may include the five locations across the center line, while other lines may form different combinations of locations, such as the top location on the first three wheels, followed by the center location on the fourth wheel, and followed by the bottom location on the fifth wheel.

In bet field 124 the player enters the amount being bet for each line, and the total bet field 134 indicates the total amount bet in the current spin. Counter 142 indicates the amount of currency owned by the player for placing bets in the slots game. The total bet amount is equal to the number of lines 126 times the bet per line 124. A maximum lines button 130 provides a shortcut to the player for betting the maximum number of lines. When the player gets a winning combination of the wheels, the total win field 132 indicates the amount won. The chat area 122 allows players in the same room to exchange messages with each other or with the whole community in the room.

In the adventure area 138, an adventure game takes place that is inter-link with the gambling game. A pet 108 (also referred to as an avatar or a mount) advances along a road 114 to get points, overcome obstacles, play mini-games, etc. To move the pet 108, the player spins the slots 140 situated below the adventure game 138, and the prizes obtained in the slots cause the pet to advance in the adventure game.

In one embodiment, the amount of progress made by the pet 108 is proportional to the amount of winnings, where if there are no winnings in a spin of the wheel, then there is no advancement, and if there is a win after spinning the wheel, the advancements is proportional to the amount won. In another embodiment, pet 108 always makes some progress after spinning the wheel, and the progress is proportional to the amount won, where a little progress is made if there is no win in the slots, and if there is a win in the slots, then the progress is proportional to the win and is bigger than the progress made when no amount is won.

In one embodiment, the gambling game and the adventure-type game are interlinked, which means that the some operations in one game affect the progress of the player in the other game. In another embodiment, some operations in a first game affect the progress in a second game, and some operations in the second game affect the progress in the first game.

In one embodiment, the gambling game is selected from a group consisting of a slots game, a poker game, a blackjack game, a bet on a sports event, other casino games, etc. For description purposes, embodiments presented here utilize a slots game, but the principles may be utilized for any type of gambling game.

In one embodiment, the adventure-type game includes an avatar that travels along the road, and the progress of the avatar along the road, as well as some of the rewards obtained by the avatar, depend on the outcomes in the gambling game. In other embodiments, the outcome in the gambling game may result in a plurality of operations in the adventure game, such as advancing on the road, traveling in different directions in a game map, unlocking new game areas, obtaining rewards, obtaining new assets, obtaining additional game currency for the adventure game, etc.

In one embodiment, even when the player loses, the player obtains meta-cash, which can be used to buy virtual items, but not to play the slots machine. In one embodiment, the meta-cash 112 randomly appears on the road (e.g., in the form of gems), and as the pet collects the meta-cash, the meta-cash is added to the meta-cash counter 110. In addition, the pet 109 may find other rewards as the pet advances along the road, such as special keys, special gems, energy, etc.

Adventure progress bar 106 is a graphical indicator of the progress made by the player along the road. In one embodiment, the road is considered infinite because the road does not have a defined end. As the pet moves along the road, adventure progress bar 106 fills up, and when the adventure progress bar 106 is completely filled up, some rewards are given to the player and the adventure progress bar is reset, for example to start a new level.

Contribution progress bar 111 shows the amount of contribution made by the player. As used herein, the contribution measures how much the player has won, independently on how much the player has bet. In one embodiment, contribution would be the amount the player had won, assuming the player had bet $1 (even if the player bet a different amount). Contribution can also be thought as the sum of the bet multipliers obtained by the player. In a typical slots machine, a winning table describes how much the player will win when the player obtains a winning combination, where the amount won is equal to the amount bet times the bet multiplier associated with the respective winning combination. In one embodiment, the contribution is equal to the figures listed in the winning table. As described below, the contribution is sometimes used when fighting an enemy, and the damage inflicted on the enemy is proportional to the contribution. This way, the damage does not depend on the amount of money bet by the player, thus avoiding the situation where big-betting players would defeat the enemy easily.

FIG. 1B illustrates a GUI for building a crew to fight the boss (e.g., the dragon). In one embodiment, the player is given the option to fight the boss with a crew of friends, also referred to as a battle group. During the game, crew building interface 150 is presented to alert the player that a fight with the boss, also referred to herein as the enemy, is approaching. In one embodiment, the damage inflicted on the enemy is equal to the contribution earned by the player during the fight.

The player may increase the damage inflicted on the boss by adding friends 152, 154 to the fighting crew. The more players that are added to the fighting group, the bigger the damage multiplier (i.e., contribution) will be. Crew building interface 150 lists one or more of the friends playing the game with the player. For each player, an icon associated with the player is presented, the name of the player, the mount or pet of the player, and a damage multiplier.

For example, if one friend 152 (named Joe in this exemplary embodiment) is added to the group, then the contribution is multiplied by two, and the damage to the common enemy will increase by a factor of two. If players 152 and 154 are added to the group, then the damage multiplier is three, etc.

In addition, the player is given the option to invite other friends 156, 158 to participate in the upcoming battle. A button is provided in order to start the process to invite a friend, such as by selecting a friend from a group of social links of the player, or selecting some of the friends of the player in the game. The contribution increases when a friend is invited to participate in the battle. In one embodiment, if the player selects several friends and/or invites one or more friends, the resulting contribution is a combination of the multipliers for the different options selected, such as adding the contributions (i.e., multipliers) of the selected options to come up with the final contribution. But other calculations for calculating the contribution are also possible.

FIG. 1C displays a page presented to the user before starting the battle with the boss. Display area 170 includes a boss health bar 180 indicating how much has the player contributed to defeat the enemy to date (e.g., how much the health of the enemy has decreased), and what is the amount required to defeat the enemy. In the exemplary embodiment of FIG. 1C, the player has already inflicted a damage of 586, out of 5,000 contribution units required to beat the boss. It is noted that the fight with the boss is a fight that encompasses one or more battles, where each battle is performed at different point in time, such as every time the community progress bar 210 (see FIG. 2A and the corresponding description below) is filled by the community.

In one embodiment, the community fights the dragon together and the damage inflicted on the dragon is based on the damage inflicted by all the players. In another embodiment, each player fights her own dragon and the damage inflicted is based solely on the contribution by the single player.

Display area 170 further includes a counter 172 of the contribution made to date, the number of lines unlocked 174 by the player, and a number of spears 176 found by the player. In addition, the display area 170 further includes the crew, if any, that the player has assembled to fight the dragon, which may include friends 182, 184, and one or more helpers 186 provided by the game. The player has the option of adding helper pets to fight the enemy by spending virtual currency to acquire the helper pets.

It is noted that the embodiments illustrated in FIGS. 1A-1C are exemplary. Other embodiments may utilize different layouts, adventure games, game themes, betting mechanisms, etc. The embodiments illustrated in FIGS. 1A-1C should therefore not be interpreted to be exclusive or limiting, but rather exemplary or illustrative.

Figure 2A:
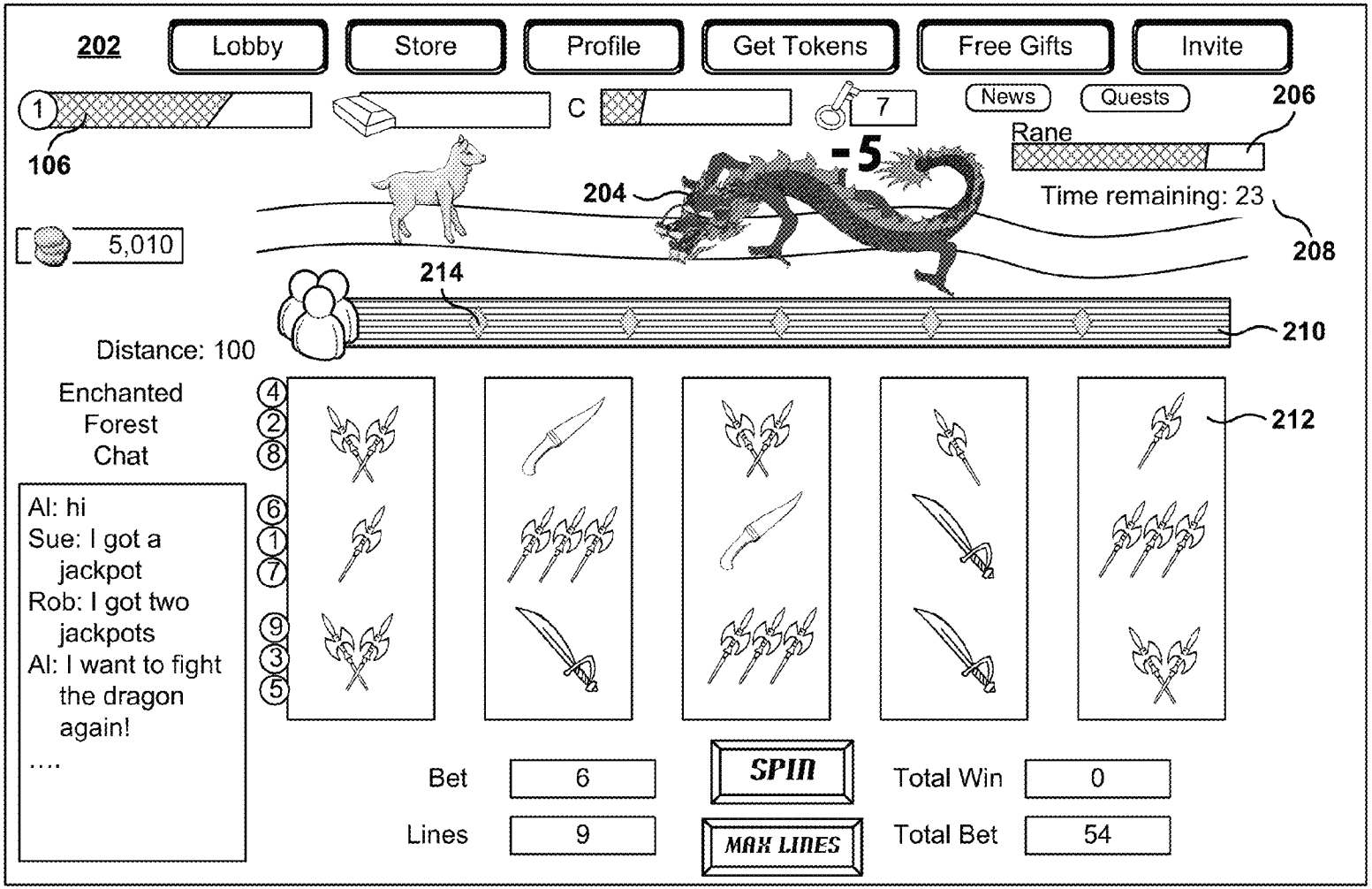
FIG. 2A is a GUI for fighting a common enemy in the social gambling room, according to one embodiment.

FIG. 2A is a GUI 202 for fighting a common enemy in the social gambling room, according to one embodiment. The players playing slots in the same room (also referred to as playing in the same slots machine) are also playing as a team to make progress in the adventure game. The team collaboration is referred to as a progressive collaboration game.

Community progress bar 210 shows the progress made by the players as a team in the current slots machine. As the players get winnings in the slots game, the community progress bar 116 gets filled to indicate the progress of the players as a group. Milestones 214 in community progress bar 210 define special locations, that when reached by the group, cause the game to reward the players, provide a game challenge, or perform some other game operation. In one embodiment, when the group reaches milestone 214, a special game operation takes place, such as giving the players more energy or prices, increasing the experience level, providing a mini-game, battling against a common enemy, etc. In the another embodiment, when community progress bar 210 gets completely full, a challenge is presented to the room as a whole, for example by fighting the dragon 204 together. After the challenge is completed, the community progress bar is reset back to the beginning, i.e., the community progress bar 210 is emptied, or the value of a counter associated with the progress made in the community progress bar is reset to zero, or to some other initial value.

The community approach to fill the community progress bar provides a collaborative experience to the players in the room, because the players fill the community progress bar by working together. The players in the room do not compete against each other to fill the community progress bar, but rather they cooperate to advance in the game.

As used herein, the slots game is in a first gambling mode during the normal operation of the game, that is, when players are betting on the slot wheels in order to make progress in their adventure game and to fill the community progress bar. When the community progress bar 210 gets filled, the slots game enters into a second gambling mode (also referred to herein as community-task mode, community game, or community mini-game), where players bet on the slots and the winnings are used to determine the progress made towards fulfilling a community goal, such as beating the dragon 204 (also referred to herein as a common enemy). In another embodiment, the second gambling mode may also be entered when the community progress bar reaches a milestone. In one embodiment, when the players are in the second gambling mode, the value of the community metric (i.e., the community progress bar) does not change.

The embodiment shown in FIG. 2A illustrates an exemplary community goal of beating the dragon 204 (which is also referred to as fighting a boss or fighting a common enemy). In other embodiments, the community goal may be one of fighting a boss, building a vehicle, building a house, building a bridge, building some other object, clearing an obstacle in the road, destroying a wall, clearing a minefield, destroying a tank, destroying an army, destroying an airplane, killing threatening animals, etc.

In the illustrated embodiment of FIG. 2A, when the community progress bar gets filled, dragon 204 appears on the road, and the pet of the player has to fight the dragon together with the fellow players in the room. In one embodiment, the players have a predetermined amount of time (e.g., 30 seconds, although other periods are also possible) to fight the dragon. Health bar 206 shows the remaining life or health left in the dragon, which is named Rane in this example. A clock 208 indicates the amount of time left in the battle.

In one embodiment, the slot wheels of the first gambling mode are different from the slot wheels in the second gambling mode. The slot wheels are thematic, that is, the wheels follow the theme of the first gambling mode or the second gambling mode. For example, while fighting the dragon, the wheels include icons of weapons, such as swords, spears, shields, knives, etc.

In one embodiment, the damage inflicted on the common enemy is proportional to the amounts won by the players when playing the slots. If the common enemy is defeated in the allotted time, then all the players in the room get rewards. However, if the common enemy is not defeated, the first gambling mode is resumed without getting rewards, or getting fewer rewards than if the common enemy were defeated. In one embodiment, the status of the common enemy is persistent, which means that the parameters associated with the common enemy (e.g., health) are kept in the game, and the next time that the room fights the common enemy, the common enemy starts with the saved parameters (e.g., with the saved amount of health), instead of starting a new battle.

As previously discussed, in one embodiment, the common enemy is fought together by the whole room, while in another embodiment each player fights her own enemy. Further, in one embodiment, the damage inflicted on the dragon is based on player winnings. In another embodiment, the damage inflicted on the enemy is based on player contribution.

Figure 2D:
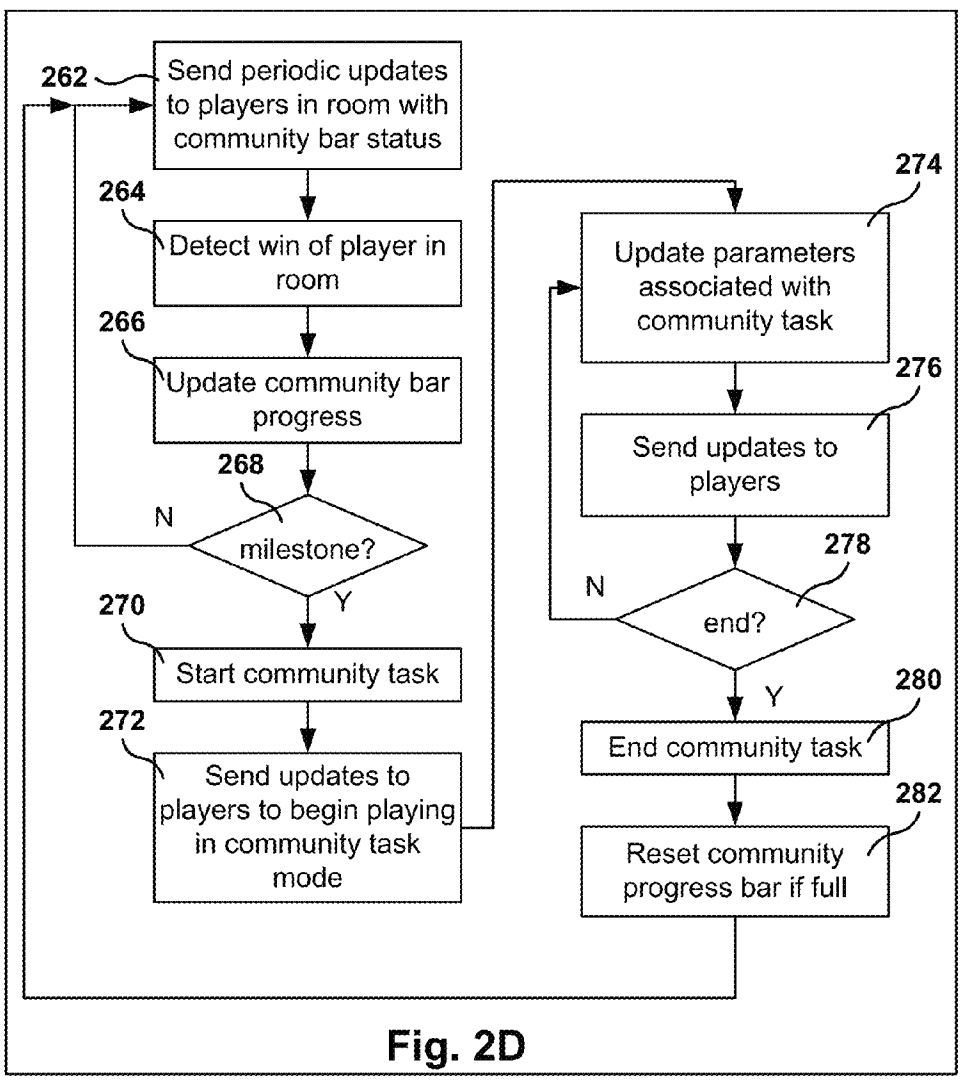
FIG. 2B-2D are flowcharts for playing a social gambling game, according to several embodiments.
Figure 2B:
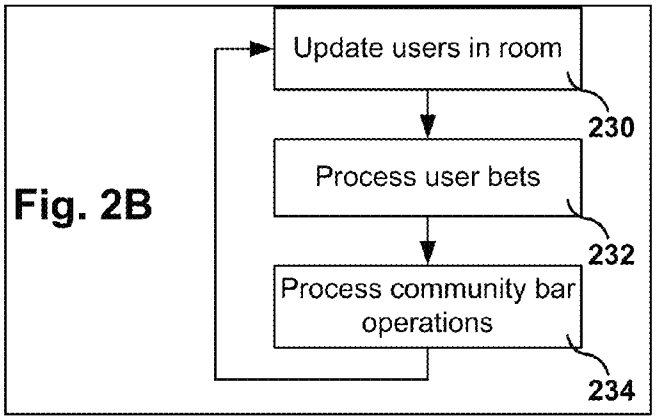
Figure 2C:
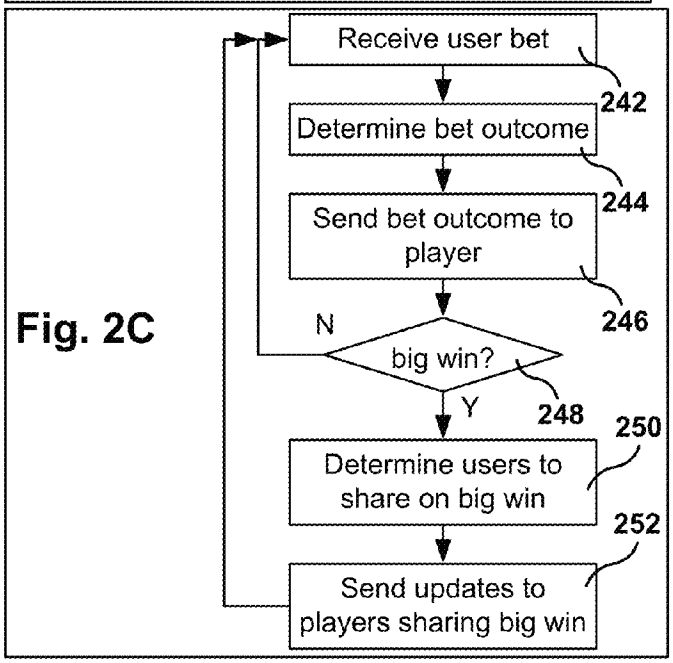

FIG. 2B-2D are flowcharts for playing a social gambling game, according to several embodiments. FIG. 2B is a flowchart describing operations performed by the game server. In operation 230, the game server updates the status of the users in the gambling room. For example, the game server detects the players entering the room and leaving the room. In addition, the game server may enforce maximums for the amount of players allowed in the gambling room.

From operation 230, the method flows to operation 232 where the bets in the gambling game are processed by the game server. More details regarding operation 232 are given below with reference to FIG. 2C.

From operation 232, the method flows to operation 234 where the game server processes operations in the game related to the community progress bar. More details regarding operation 234 are given below with reference to FIG. 2D.

FIG. 2C is a flowchart regarding the operations performed by the game server to process user bets. In operation 242, a bet for the gambling game is received, and in operation 244, the outcome of the bed is determined. In one embodiment, the outcome of the bet is determined at the server and is based on several factors, such as the rules of the gambling game, rules set up by game designers, randomness, etc. It is noted that, in another embodiment, the outcome of the bet is determined at the client, and the client game software includes program instructions for determining outcomes based on the rules set by the game designers.

From operation 244, the method flows to operation 246 where the outcome of the bet is sent to the player's game device, i.e., the client device. In operation 248, a check is performed to determine if the player had a big win. The rules for determining what a big win is are set by game designers. If the player did not get a big win, the method flows back to operation 242 to wait for another user bet. However, if the player received a big win in the gambling game, the method flows to operation 250, where the game determines which players in the gambling game will get a share of the win, and the amount of the share.

From operation 250, the method flows to operation 252 where update messages that include the share of the big win are sent to the fortunate players that are sharing in the big win. From operation 252, the method flows back to operation 242 to wait for a new user bet.

FIG. 2D is a flowchart regarding the community-progress-bar operations performed by the game server. In operation 262, the server sends periodic updates to the player devices of the players in the room. The updates include community progress bar information in order to keep the players display of the community progress bar up to date. In operation 264, a win is detected for one of the players in the room. From operation 264, the method flows to operation 266 where the community progress bar is updated based on the detected win in operation 264. In one embodiment, the update to the community progress bar includes an increment to the value of a counter associated with the community progress bar. In another embodiment, the increment is based on the amount won by the player, but in other embodiments other increments are also possible, such as adding the same increment every time a player wins, etc.

From operation 266, the method flows to operation 268 to perform a check to determine if a milestone in the community progress bar or the end of the community progress bar has been reached. If the milestone or the end have been reached, the method flows to operation 270, and to operation 262 otherwise.

In operation 270, the game enters a second gambling mode, which includes performing a community task (e.g., fighting a common enemy). From operation 270, the method flows to operation 272 where updates are sent to the client devices in order to notify the devices that the community task mode has started. In one embodiment, once the community task mode starts, the interface for the gambling game changes, such as in the embodiment shown in FIG. 2A.

In operation 274, the parameters associated with the community task are updated based on the progress made by players in the second gambling mode. For example, as players when in the slots game, the health of the common enemy is decreased based on the winnings of the players. In operation 276, updates regarding the parameters associated with the, enemy are sent to the players in the room.

In operation 278, a check is made to determine if the second gambling mode has terminated. If the second gambling mode has not terminated, the method flows to operation 274, and if the second gambling mode has ended then the method flows to operation 280, where the community task is ended. Updates are sent to the client devices in order to communicate that the community task has ended. In addition, results regarding the community task performance are also sent to the players, in one embodiment.

In operation 282, the community progress bar is reset if the community progress bar has been filled, or in other words, the completion of the community progress bar caused the start of the community task. From operation 282, the method flows to operation 262 where the players enter the first gambling mode.

It is noted that the embodiments illustrated in FIGS. 2B-2D are exemplary. Other embodiments may utilize different operations, additional operations, or have different game modules perform some of the operations. The embodiments illustrated in FIGS. 2B-2D should therefore not be interpreted to be exclusive or limiting, but rather exemplary or illustrative.

Figure 3:
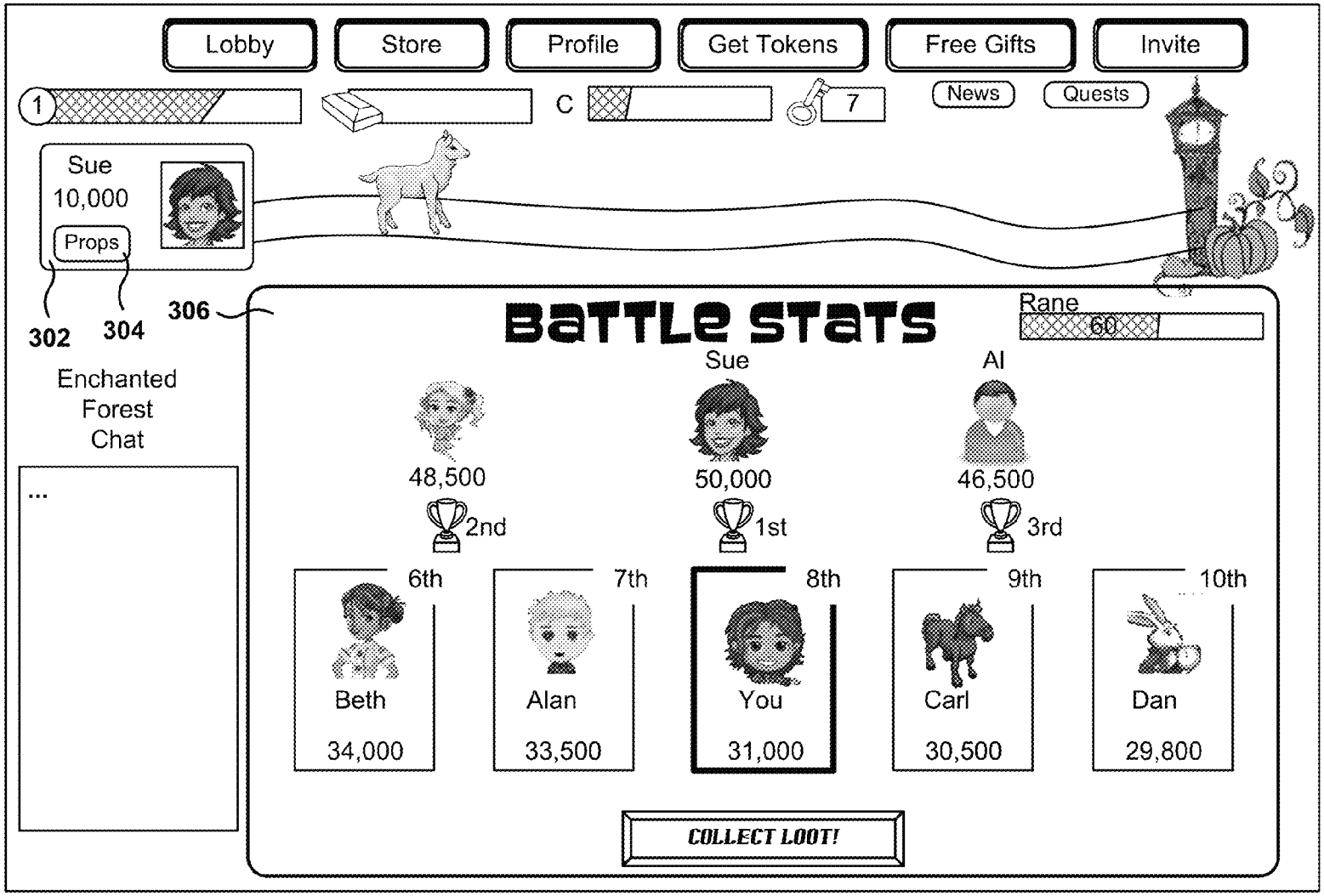
FIG. 3 shows the results of the battle between the room players and the common enemy, according to one embodiment.

FIG. 3 shows the results of the battle between the room players and the common enemy, according to one embodiment. After the community task ends, a message appears with a summary of the outcome of the community effort. In one embodiment, battle statistics 306 display the amount of damage done against the enemy, and a leaderboard of the top performers in the battle against the enemy.

By showing the leaderboard, players are encouraged to do better than other players, which introduces a competition aspect to the group effort. In the embodiment of FIG. 3, the dragon still has 60 percent of life remaining, and the next time the community (or the player alone) confronts the dragon, the dragon will start with 60 percent of life remaining. In other words, the parameters associated with the common task (e.g., the life of the dragon) are persistent and do not disappear at the end of this episode of the community task.

In one embodiment, players may give other players recognition or appreciation for a good performance in the common task. This recognition is referred to herein as a "prop." In one embodiment, one or more of the top performers are displayed 302 with an option button 304 titled "Props." If a player clicks in the props button 304, a counter of props associated with the selected player is incremented. This way, as the player gets recognition from peers, the props counter increases giving a measurement of the level of recognition or popularity of the player in the game.

In one embodiment, as a player receives more and more props, some recognition animation is performed in the board of the player, such as fireworks, flags, banners, messages of recognition, etc. This positive reinforcement encourages the player to "work for the community" in order to increase the number of props.

In another embodiment, the player may also get props after a big win during the first gambling mode. Since some players share some of the winnings after getting a big win, other players are motivated to give props to the winner of the big win, because the big win results in rewards for the players sharing the good fortune.

In general, players may be able to receive props from other players for additional reasons, such as being an active participant in the chat board, or providing encouragement to other players, etc. It is also noted that community progress bar 210 is reset to a zero level at the end of the community task.

Figure 4:
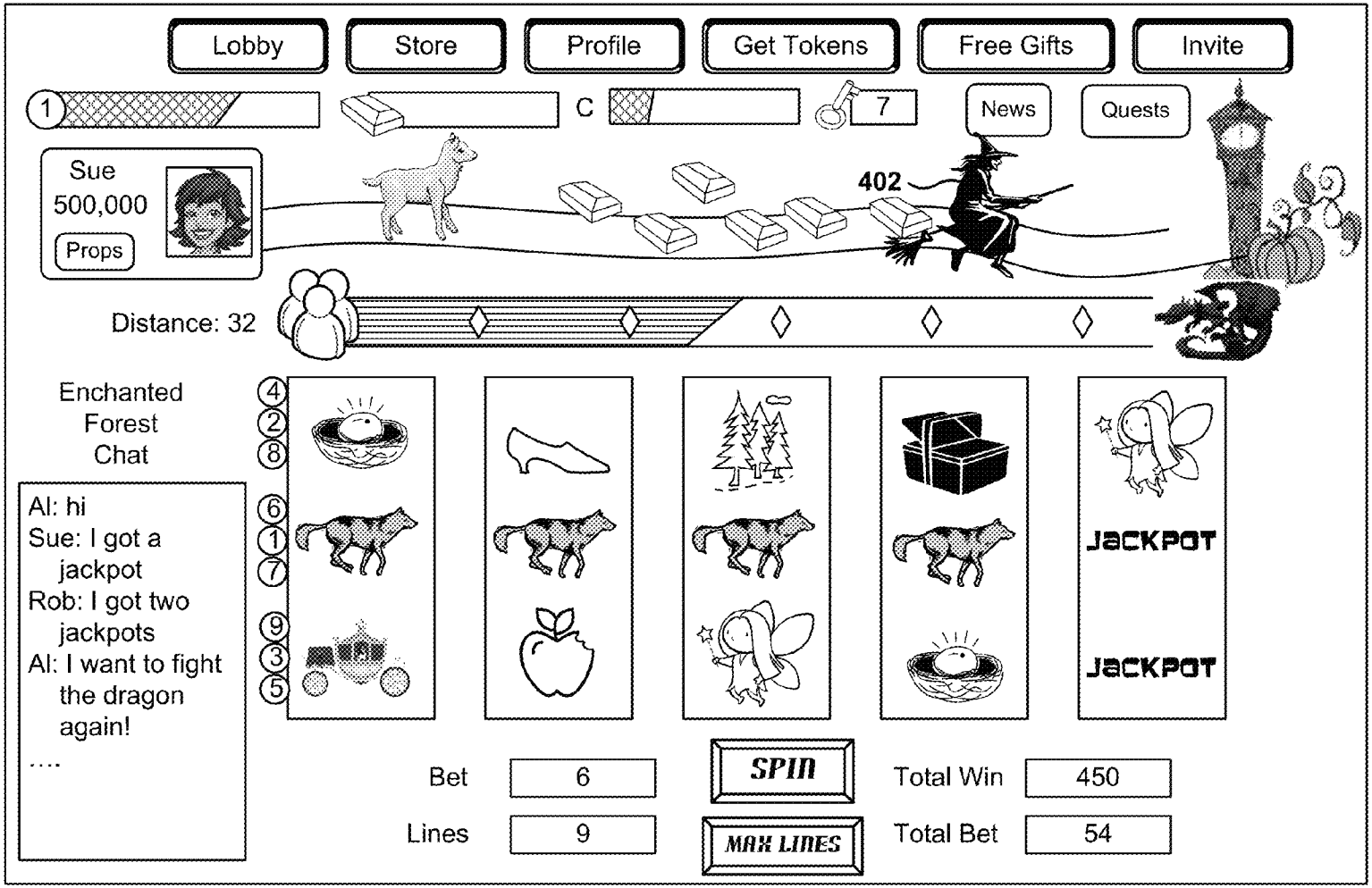
FIG. 4 shows an embodiment for delivering rewards to the players in the room.

FIG. 4 shows an embodiment for delivering rewards to the players in the room. As mentioned above, players that get big wins share some of the rewards with other players. By sharing, it is not meant that the lucky player gives some of her winnings to other players, but rather that the game also gives rewards to other players. In one embodiment, the winner appears on the screen of other players in the room while sharing some of the winnings. In another embodiment, the sharing is done by dropping gems in the roads of other players so their pets can pick up the gems in the road as they walk along.

In one embodiment, an animation is shown in the screens of other players to indicate the sharing of the big win. The animation includes dropping gems, or some other asset on the road, and the pet of the player picks up the dropping gems as the pet advances on the road. In the embodiment of FIG. 4, a witch 402 flies by the path of the adventure game while dropping gems that are later collected by the players' pets.

In one embodiment, the server detects when a player gets a big jackpot (i.e., a big win) and proceeds to place the shared rewards (e.g. gems) on the road, or to give the rewards to players in some other fashion. In one embodiment, the rewards given to players are different for friends and for non-friends. In one embodiment, friends get more rewards than non-friends.

The rules for sharing include parameters associated with the rules, such as the size of the minimum jackpot won by a player in order to share the good fortune with other players, what are the amounts that are shared with other players, when to share with friends or with non-friends in the game, etc.

Figure 5:
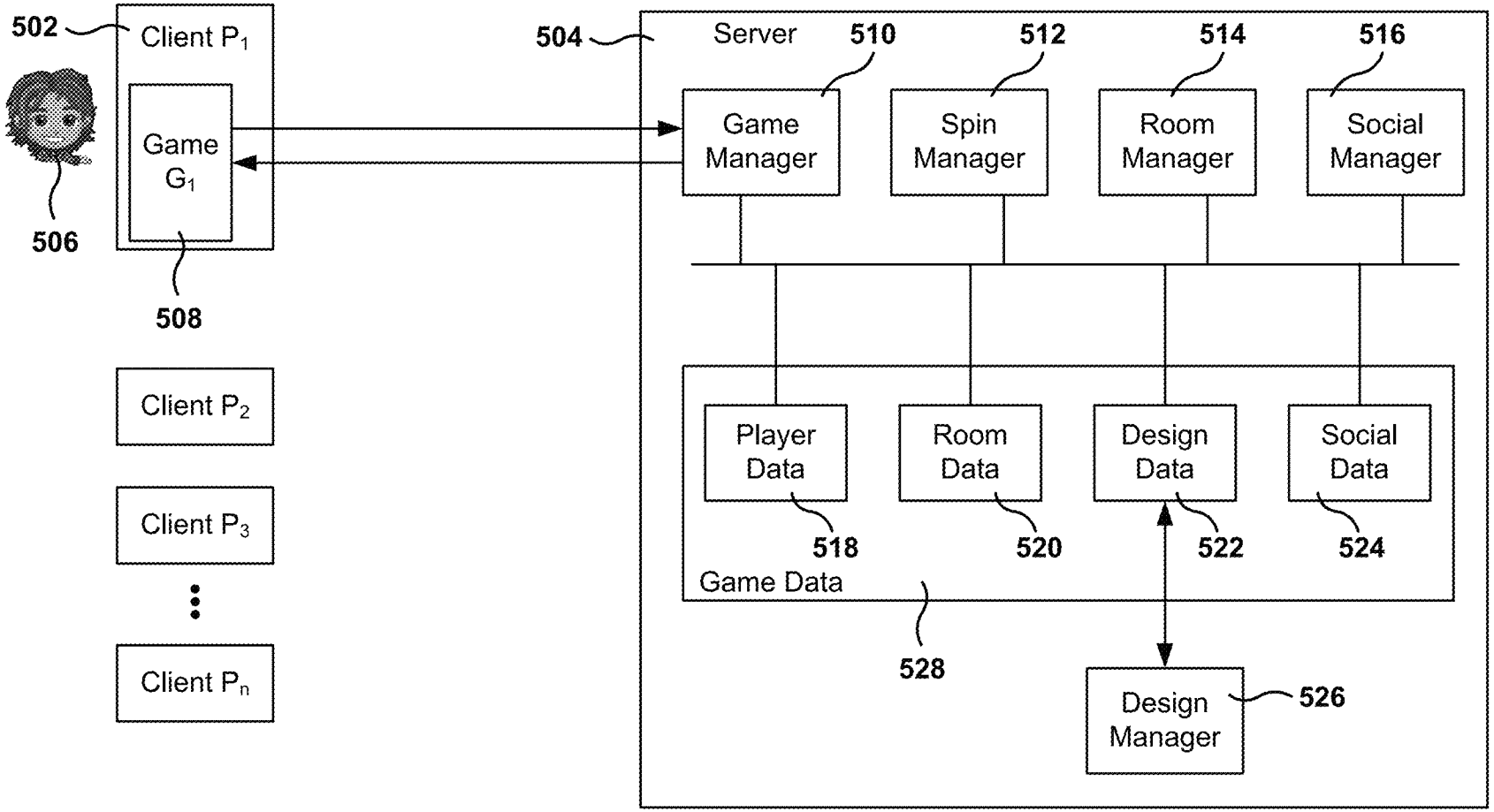
FIG. 5 illustrates the structure of the server for the slots game, according to one embodiment.

FIG. 5 illustrates the structure of the server for the slots game, according to one embodiment. The online game is hosted by server 504, which includes game manager 510, spin manager 512, room manager 514, social manager 516, design manager 526, and game data 528. A player $P_1$ 506 plays the game utilizing client device 502 executing a computer program. In one embodiment, the client device 502 utilizes a web browser 508, and in another embodiment other computer programs may also be utilized to play the game, such as a computer program loaded on a computing device for the exclusive purpose of playing the game.

In one embodiment, game manager 510 manages the game operations for each of the players, and interacts with other modules to perform respective game operations within the game. In addition, the game manager 510 manages the game data stored for running the player's games, although other modules may also access and change some of the game data. In one embodiment, the functionality implemented by game manager 510 includes presenting the game board to the player (e.g., including the gambling game and the adventure game), presenting options to the player for customizing and controlling an avatar or mount of the game, providing an interface between the player and other game modules, synchronizing game operations with client 502, managing communications with client 502, etc.

Spin manager 512 manages the gambling operations in the game. In one embodiment, spin manager controls the amount that may be wagered by the player in the gambling game (e.g., number of lines, amount bet per line, etc.). In one embodiment, spin manager 512 receives a betting instruction from client 508 and performs a game simulation regarding the chance game being played. For example, the spin manager "spins" the wheels and determines the outcome of the spinning, including a possible win amount. The calculation of prizes is also referred to as game mechanics for calculating prizes in the slots game. The calculation is based on game rules and a degree of randomness related to the game of chance.

The probability of winning is driven by data set up by game designers. The design data specifies the symbols on the wheels, the combinations that result in payouts, the odds, etc. In one embodiment, the spin manager exchanges information with the road manager 514 to determine when players are in a first gambling mode or in a second gambling mode. As discussed above, in the first gambling mode players that in the gambling game to obtain virtual currency and other prices, and also cooperate with other players in the room to fill the community progress bar. In the second gambling mode, the players in the room cooperate to achieve a community task different from filling up the community progress bar.

After calculating the result of the spin, spin manager 512 sends the result back to the client game 508. In another embodiment, the spinning of the wheels is performed in the client device 508, and the client device 508 synchronizes with spin manager 512 to share the results of the betting operations in the gambling game.

Room manager 514 manages the gambling room, the place where a plurality of players play the gambling game, while also cooperating on same game objectives. In a way, each player has its own personal game with its own personal objectives, but all the players also share one common game that is interrelated with the individual games.

In one embodiment, the common game relates to a community progress bar, and involves some periods of cooperation, such as when all the players in the room work together to beat a dragon that appears in the adventure game. In one embodiment, there is collaboration in the game, and as every player spins and gets points the bar gets filled for the whole room. All player devices (such has player device 508) in the same room provide updates to the server so the room manager 514 may calculate the progress of the room in the progress bar. Therefore, the clients send updates to the server 504, and the server 504 periodically sends out the current state of the community progress bar (e.g., every five seconds, although other periods are also possible). In one embodiment, the frequency of updates is determined by the game designers and is kept in design data 522.

In addition, room manager 514 periodically checks the position of each of the players in the room within the road of the adventure game. In one embodiment, when two friends are in the same area in the road, room manager 514 sends updates to each player so the GUI of each player displays the name, or some other symbol, associated with the friend. In one embodiment, to increase the awareness of other players being in the room, room manager 514 will also send instructions to display the pets from some players that are not friends, in order to see more traffic in the game road. If the game road has a large number of players, not all players are displayed on the road, because it would lead to congestion in the screen.

Social manager 516 manages the social interactions of the players, which include determining the social links established within the game and outside the game among the players. For example, the social manager 516 may suggest friends in the social network to the player that may become friends within the game.

Game data 528 represents one or more databases that hold game related data. In one embodiment, game data 528 includes player data 518, room data 520, design data 522, and social data 524. Social data 524 includes the relationships established by players in the game within the game, and the relationships existing among the players in one or more social websites.

Design manager 526 provides an interface to the game designers in order to configure the different parameters for operating the game. In addition, the design manager 526 manages the design data 522, which is utilized by the different game modules to determine the outcome of certain game operations in the game, such as winning a bet, collecting gems on the road, or determining which mounts are available at which levels.

It is noted that the embodiments illustrated in FIG. 5 are exemplary. Other embodiments may utilize different game modules, different data modules, or combine the functionality of one or more modules into a single module. The embodiments illustrated in FIG. 5 should therefore not be interpreted to be exclusive or limiting, but rather exemplary or illustrative.

Figure 6A:
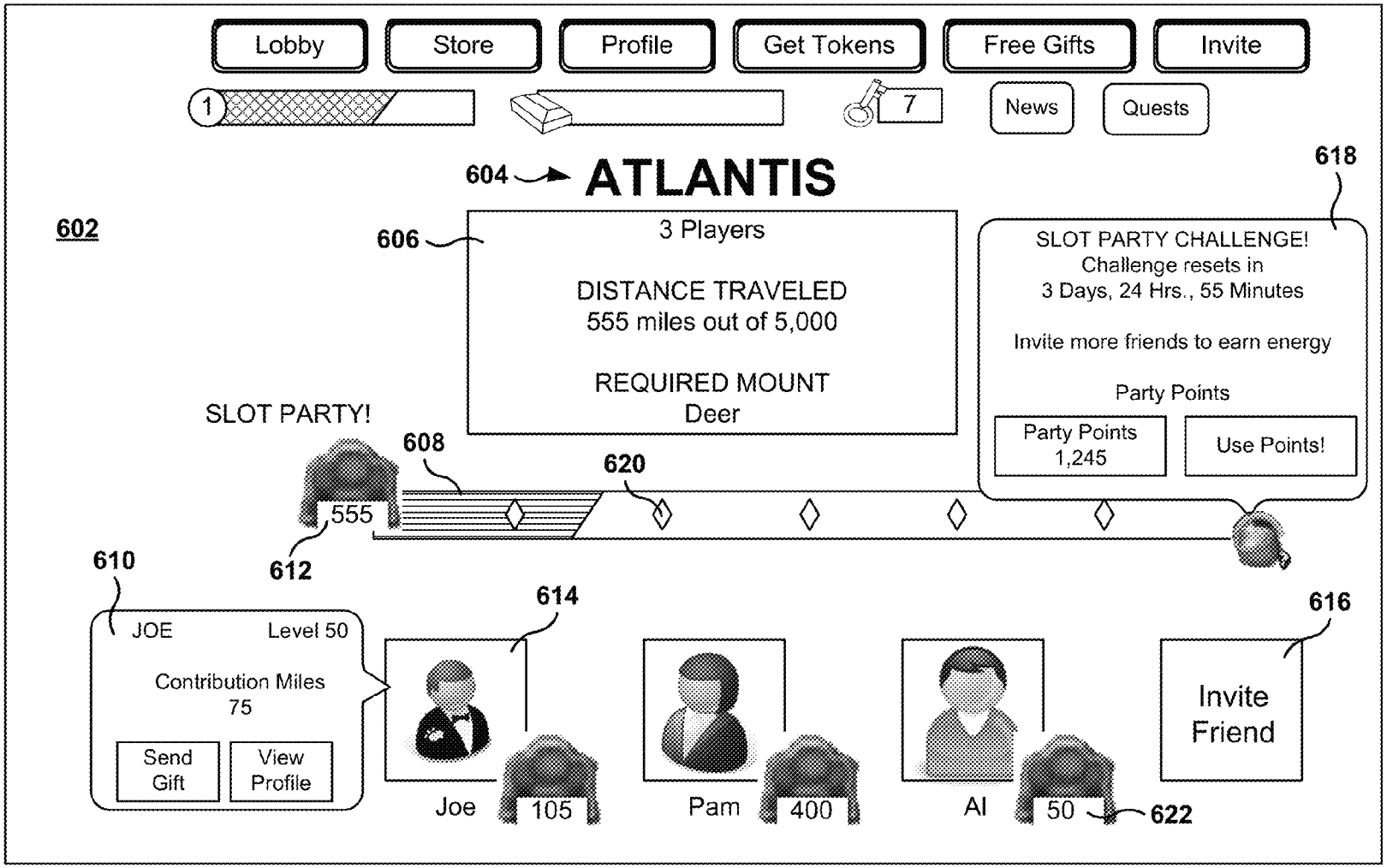
FIG. 6A is a GUI for playing a team challenge in the gambling game, according to one embodiment.

FIG. 6A is a GUI 602 for playing a team challenge in the gambling game, according to one embodiment. A player in the gambling game may initiate a team challenge, which, as its name implies, provides a challenge to a group of players that must be completed in a predetermined amount of time (e.g., one week, but other time periods are also possible). In one embodiment, the creator of the team challenge gets game rewards for starting the team challenge.

In one embodiment, the challenge involves traveling a certain amount of miles in an adventure game associated with the gambling game. The traveling for the challenge is the sum of the distance traveled by all the players that participate in the team challenge. In other embodiments, other types of measurements for the team challenge are also possible, such as winning a certain amount of virtual currency, performing certain community tasks (e.g., defeating the dragon) a certain number of times, etc. Goals message 606 provides team challenge information for the team challenge, such as the number of players currently enrolled, the amount of distance traveled to date, the total amount of distance required to complete the challenge, the mount or pet required for the team challenge (e.g., a deer), etc. Name 604 describes the name for the team challenge, which may be provided by the game or renamed by the player initiating the team challenge.

The initiator of the team challenge may invite friends to participate in the team challenge, and the invited friends may invite their friends, and so on. The more players participate in the team challenge, the easier it is to complete the team challenge. In one embodiment, the requirement to complete the challenge is not a function of the number of players participating. Therefore, the more players that participate in the team challenge, the easier it is to complete the team challenge.

In another embodiment, the goal to complete the team challenge is a function of the number of players participating. For example, a team challenge with 10 players may have lower requirements than a team challenge with 1000 players. However, in order to encourage viral participation, the requirements may not be linear, that is, the goal for 1000 players is not equal to 100 times the goal for 10 players. In one embodiment, the more players that participate, the higher the goal, but the more players participate the smaller the requirement per player is. The requirement per player is defined as the total requirement to complete the team challenge divided by the number of players in the team.

In order to make progress in the team challenge, a player participates in the game, as previously discussed with reference to FIGS. 1, 2A-2D, etc. But, the game keeps track of the progress made in the gambling game in order to update the progress counter in the team challenge bar.

In one embodiment, when the player clicks or mouses over an icon at the end of the team challenge bar 608, and information message 618 is displayed. The information message 618 includes the amount of time left in the challenge, an option to invite other friends, the amount of party points awarded by the game, an option to use the party points, etc. A party point is a special game asset available to players in the team challenge. A counter 612 provides a value (e.g., 525 miles) for the amount of progress made in team challenge bar 608.

As players make progress in the team challenge, party points are awarded to the players, and these party points may be used to acquire assets in the game, such as energy, endurance, additional bonus traveled miles in the team challenge, etc. The more players play in the gambling game, the more party points they get. The party points applies only to the team, and in one embodiment, there is not a separate party point counter for each of the players.

As players are active in the game, the team challenge bar 608 fills up. Therefore, as players play in the gambling game, the progress made by betting in the gambling game translates into progress made in the community progress bar of FIG. 1 and into progress towards filling the team challenge bar 608. In GUI 602, the players currently enrolled in the challenge bar are presented. In one embodiment, each player display 614 includes an icon or photo associated with the player, the name, and the amount contributed towards the team challenge 622.

In one embodiment, clicking or mousing over a player provides information 610 regarding the player in the team challenge. The information may include the name of the player, the level of the player in the gambling game, the amount of contribution to the team challenge (e.g., miles traveled), an option to send a gift to the player, an option to view the complete profile of the player in the game, etc.

In addition, an icon 616 is presented to give the player the option to invite more friends to the team challenge. In one embodiment, a player that invites other players to play the team challenge gets rewarded with some game asset, and in another embodiment the player gets an additional reward if the friend invited joins the team challenge.

If the team fills out the team challenge bar 608, prizes or rewards are given to each of the members of the team. In addition, when the team reaches a milestone 620 in the team challenge bar, additional rewards might be given to the players, such as additional energy or party points. In one embodiment, all the players get the same rewards when reaching the milestone at the end of the team challenge bar, but in another embodiment, players are rewarded according to their contribution.

It is noted that the embodiments illustrated in FIG. 6A are exemplary. Other embodiments may utilize different layouts, options, challenges, measurements of progress, different types of challenges, etc. The embodiments illustrated in FIG. 6A should therefore not be interpreted to be exclusive or limiting, but rather exemplary or illustrative.

Figure 6B:
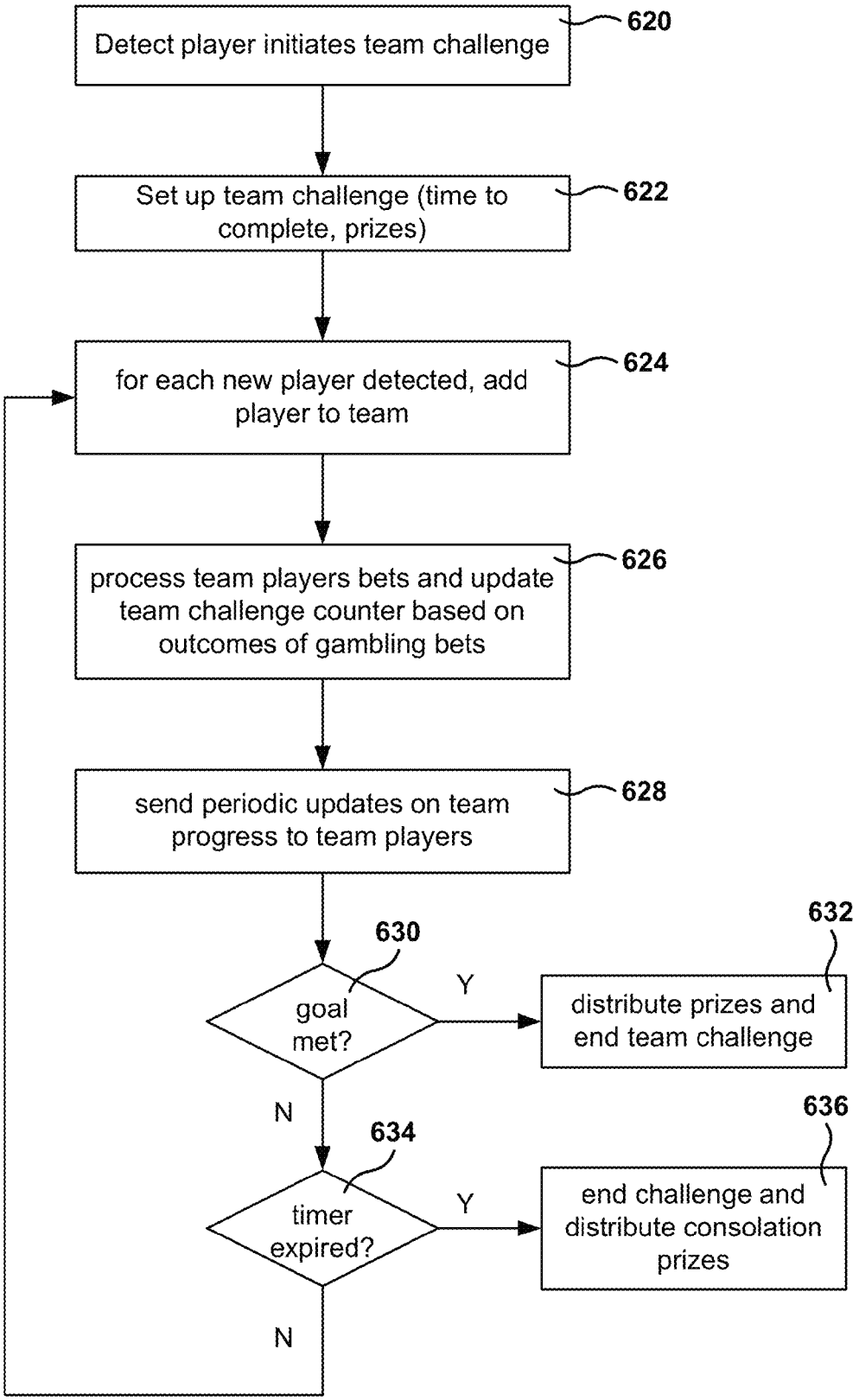
FIG. 6B is a flowchart for implementing the team challenge in a gambling game, according to one embodiment.

FIG. 6B is a flowchart for implementing the team challenge in a gambling game, according to one embodiment. In operation 620, the game detects that a player has initiated a team challenge. In one embodiment, the team challenge involves the cooperation of a plurality of players that participate in a gambling game. In order to complete the team challenge, the plurality of players play in the gambling game, and the progress in the gambling game produces the progress in the team challenge. The team challenge has predetermined goals that must be reached within a predetermined amount of time. If the players participating been the team challenge meet the predetermined goals, then rewards are given to the players participating in the team challenge.

From operation 620, the method flows to operation 622 where the game sets up the team challenge and the parameters associated with the team challenge game. The parameters may include one or more of a name for the team challenge, the amount of time allowed for accomplishing the team challenge, the rewards given for completing the team challenge or completing milestones in the team challenge, the requirements for completing the team challenge, requirements for making progress in the team challenge in the gambling game, etc.

From operation 622, the method flows to operation 624 where the new players detected wishing to participate in the team challenge are added to the team challenge. In one embodiment, there are participating rules for players to join a team challenge, such as being friend in the game or in the social network of one of the existing members of the team. In another embodiment, any player may join the team challenge, and in yet another embodiment, membership to the team challenge is controlled by the creator of the team challenge, which means that new members must first be approved by the team challenge creator.

From operation 624, the method flows to operation 626 where the game monitors the play of the team members, including tracking the bets and winnings of the team members in the gambling game. Based on the outcomes of the bets in the gambling game, the team challenge counter is updated. In one embodiment, the team challenge counter is one of the metrics utilized for determining that the team has completed the team challenge.

In operation 628, periodic updates are sent to the team members currently playing the team challenge with information regarding the progress of the team made in the team challenge. In operation 630, a check is made to determine if the goal or goals for the team challenge have been met. If the goals have been met, the method flows to operation 632 were prizes are awarded to the team members, and the team challenge is deemed complete.

If the goals have not been met, the method flows to operation 634 where a check is made to determine if the time allotted for completing the team challenge has expired. If the time has expired, the method flows to operation 636 where the team challenge is terminated and consolation prizes are distributed to the team members. If the time has not expired, the method flows back to operation 624.

Figure 7:
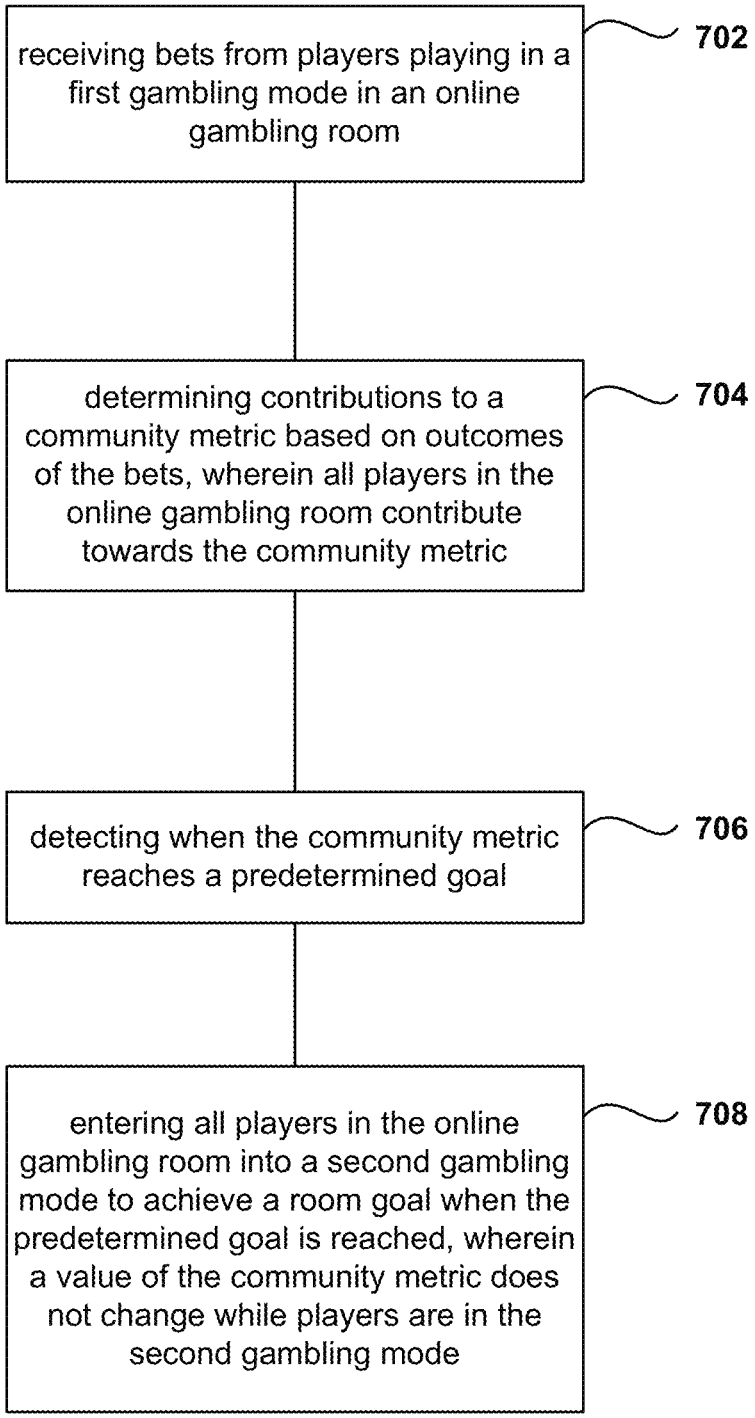
FIG. 7 shows a flowchart illustrating an algorithm for executing a computer game, in accordance with one embodiment.

FIG. 7 shows a flowchart illustrating an algorithm for executing a computer game, in accordance with one embodiment. In operation 702, bets are received from players that are playing in a first gambling mode in an online gambling room of an online gambling game.

From operation 702, the method flows to operation 704 where the game determines the contributions to a community metric that is based on the outcomes of the bets placed in the gambling game. In one embodiment, all the players in the online gambling room contribute towards the community metric. In other words, there is no competition among the players in the online game to contribute towards the community metric.

From operation 704, the method flows to operation 706 where the game detects that the community metric has reached a predetermined goal or on of the milestones associated with the community metric. In one embodiment, the community metric is based on a community progress bar, and the community metric is the advancement of the community progress bar, which is filled when the players bet in the gambling game.

From operation 706, the method flows to operation 708, where in response to the detection of the predetermined goal in operation 706, the players in the online gambling room are entered into a second gambling mode. When the players are in the second gambling mode, the players cooperate to achieve a room goal, and in the second gambling mode the value of the community metric does not change.

Figure 8:
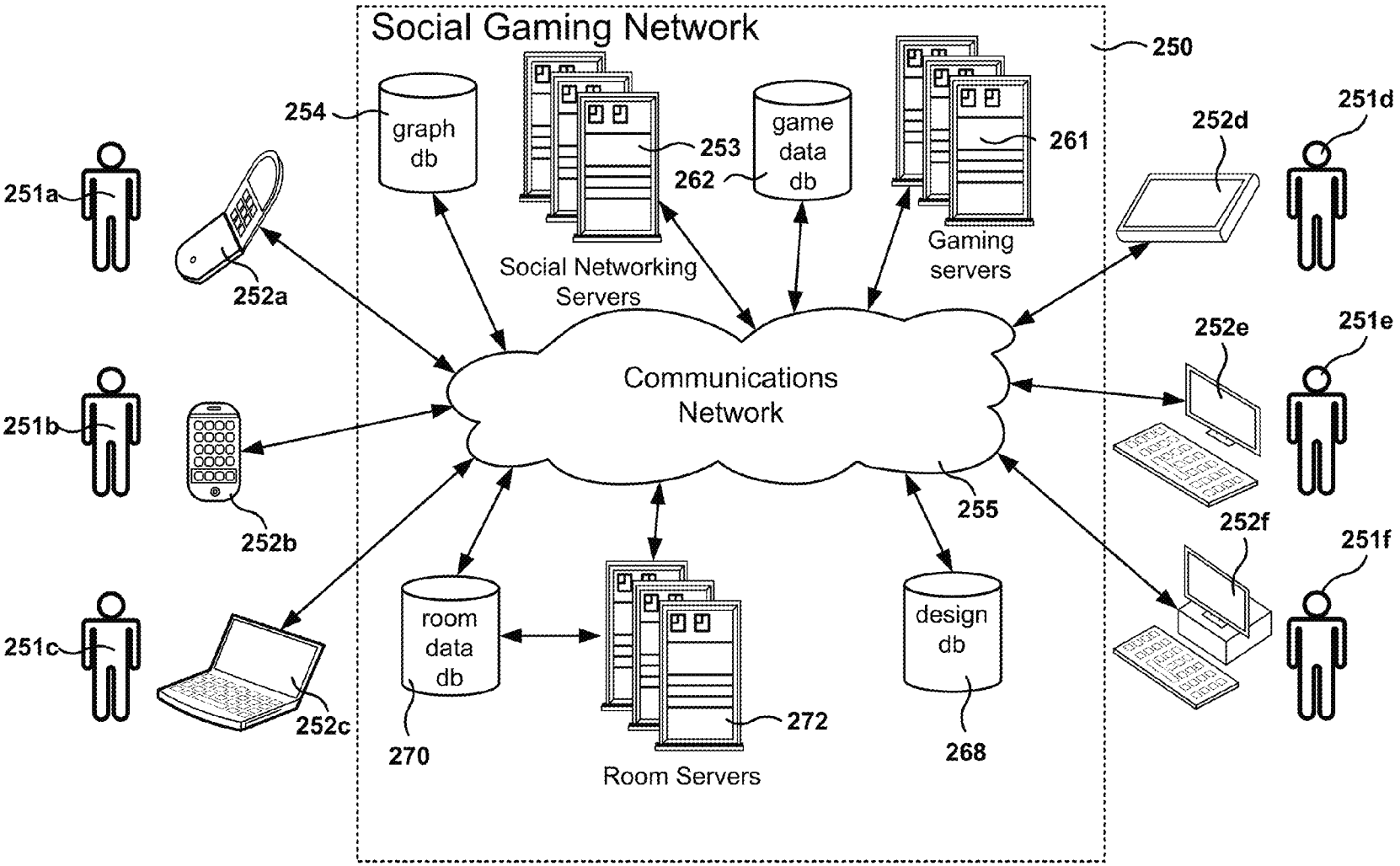
FIG. 8 shows a block diagram illustrating a social-gaming network architecture, according to one embodiment.

FIG. 8 shows a block diagram illustrating a social-gaming network architecture, according to one embodiment. In some implementations, a plurality of players (e.g., 251*a*-251*f*) may be utilizing a social gaming network 250. Each player interacts with the social gaming network via one or more client devices (e.g., client devices 252*a*-252*f*). The clients may communicate with each other and with other entities affiliated with the gaming platform via communications network 255. Further, the players may be utilizing a social networking service provided by a social networking server (e.g., social networking servers 253) to interact with each other.

When a player provides an input into the player's client device, the client device may in response send a message via the communications network to the social networking server. The social networking server may update the player profile, save the message to a database, send messages to other players, etc. The social gaming network may include a social graph database 254, which stores player relationships, social player profiles, player messages, and player social data.

The gaming servers 261 host one or more gaming applications, and perform the computations necessary to provide the gaming features to the players and clients. One or more gaming databases 262 store data related to the gaming services, such as the gaming applications and modules, virtual gaming environment data, player gaming session data, player scores, player virtual gaming profiles, game stage levels, etc. The gaming servers may utilize the data from the gaming databases to perform the computations related to providing gaming services for the players.

Room Servers 272 manage the slot rooms system in the game, including the creation, tracking, expiration, abandonment, and deletion of rooms. In addition, a room database 270 holds room information, and design db 268 holds information data.

Figure 9:
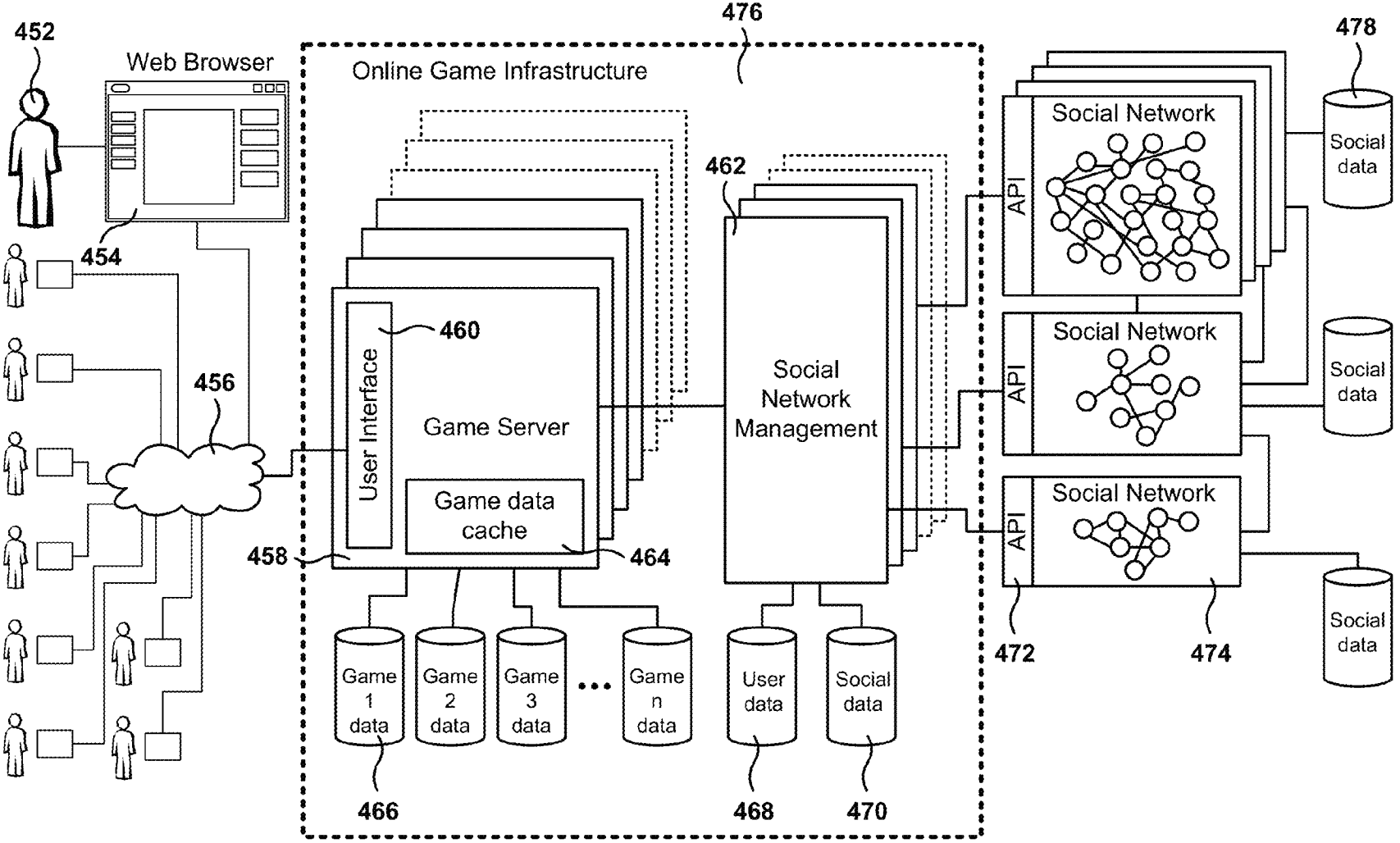
FIG. 9 illustrates an implementation of a Massively Multiplayer Online (MMO) infrastructure, according to one embodiment.

FIG. 9 illustrates an implementation of an online game infrastructure, according to one embodiment. The online game infrastructure 476 includes one or more game servers 458, web servers (not shown), one or more social network management servers 462, and databases to store game related information. In one embodiment, game server 458 provides a user interface 460 for players 452 to play the online game. In one embodiment, game server 458 includes a Web server for players 452 to access the game via web browser 454, but the Web server may also be hosted in a server different from game server 458. Network 456 interconnects players 452 with the one or more game servers 458.

Each game server 458 has access to one or more game databases 466 for keeping game data. In addition, a single database can store game data for one or more online games. Each game server 458 may also include one or more levels of caching. Game data cache 464 is a game data cache for the game data stored in game databases 466. For increased performance, caching may be performed in several levels of caching. For instance, data more frequently used is stored in a high priority cache, while data requiring less access during a session will be cached and updated less frequently.

The number of game servers 458 changes over time, as the gaming platform is an extensible platform that changes the number of game servers according to the load on the gaming infrastructure. As a result, the number of game servers will be higher during peak playing times, and the number of game servers will be lower during off-peak hours. In one embodiment, the increase or decrease of bandwidth is executed automatically, based on current line usage or based on historical data.

One or more social network management servers 462 provide support for the social features incorporated into the online games. The social network management servers 462 access social data 478 from one or more social networks 474 via Application Programming Interfaces (API) 472 made available by the social network providers. An example of a social network is Facebook, but it is possible to have other embodiments implemented in other social networks. Each social network 474 includes social data 478, and this social data 478, or a fraction of the social data, is made available via API 472. As in the case of the game servers, the number of social network management servers 462 that are active at a point in time changes according to the load on the infrastructure. As the demand for social data increases, the number of social network management servers 462 increases. Social network management servers 462 cache user data in database 468, and social data in database 470. The social data may include the social networks where a player is present, the social relationships for the player, the frequency of interaction of the player with the social network and with other players, etc. Additionally, the user data kept in database 468 may include the player's name, demographics, e-mail, games played, frequency of access to the game infrastructure, etc.

It is noted that the embodiment illustrated in FIG. 9 is an exemplary online gaming infrastructure. Other embodiments may utilize different types of servers, databases, APIs, etc., and the functionality of several servers can be provided by a single server, or the functionality can be spread across a plurality of distributed servers. The embodiment illustrated in FIG. 9 should therefore not be interpreted to be exclusive or limiting, but rather exemplary or illustrative.

Figure 10:
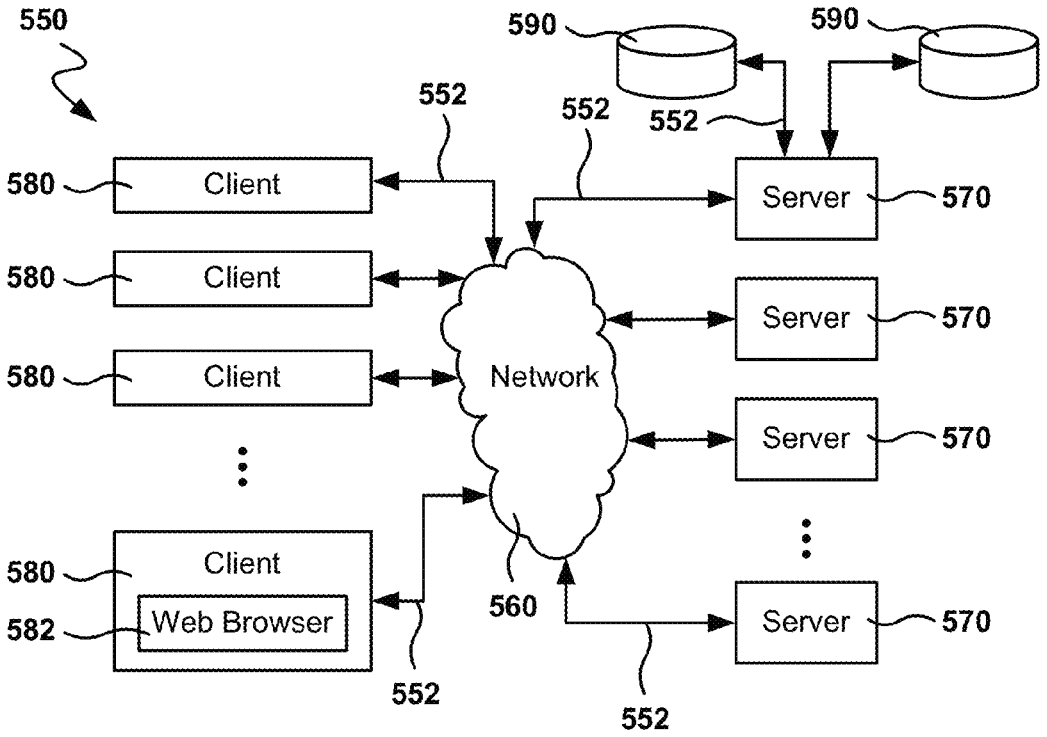
FIG. 10 illustrates an example network environment suitable for implementing embodiments.

FIG. 10 illustrates an example network environment 550 suitable for implementing embodiments. Network environment 550 includes a network 560 coupling one or more servers 570 and one or more clients 580 to each other. In particular embodiments, network 560 is an intranet, an extranet, a virtual private network (VPN), a local area network (LAN), a wireless LAN (WLAN), a wide area network (WAN), a metropolitan area network (MAN), a portion of the Internet, another network, or a combination of two or more such networks 560.

One or more links 552 couple a server 570 or a client 580 to network 560. In particular embodiments, one or more links 552 each includes one or more wired, wireless, or optical links 552. In particular embodiments, one or more links 552 each includes an intranet, an extranet, a VPN, a LAN, a WLAN, a WAN, a MAN, a portion of the Internet, or another link 552 or a combination of two or more such links 552.

Each server 570 may be a stand-alone server or may be a distributed server spanning multiple computers or multiple datacenters. Servers 570 may be of various types, such as, for example and without limitation, slots server, jackpot server, gambling server, web server, news server, mail server, message server, advertising server, file server, application server, exchange server, database server, or proxy server. Each server 570 may include hardware, software, embedded logic components, or a combination of two or more such components for carrying out the appropriate functionalities implemented or supported by server 570. For example, a web server is generally capable of hosting websites containing web pages or particular elements of web pages. More specifically, a web server may host HyperText Markup Language (HTML) files or other file types, or may dynamically create or constitute files upon a request, and communicate them to clients 580 in response to Hypertext Transfer Protocol (HTTP) or other requests from clients 580. A mail server is generally capable of providing electronic mail services to various clients 580. A database server is generally capable of providing an interface for managing data stored in one or more data stores.

In particular embodiments, one or more data storages 590 may be communicatively linked to one or more severs 570 via one or more links 552. Data storages 590 may be used to store various types of information. The information stored in data storages 590 may be organized according to specific data structures. In particular embodiments, each data storage 590 may be a relational database. Particular embodiments may provide interfaces that enable servers 570 or clients 580 to manage, e.g., retrieve, modify, add, or delete, the information stored in data storage 590.

In particular embodiments, each client 580 may be an electronic device including hardware, software, or embedded logic components or a combination of two or more such components and capable of carrying out the appropriate functionalities implemented or supported by client 580. For example and without limitation, a client 580 may be a desktop computer system, a notebook computer system, a notebook computer system, a handheld electronic device, or a mobile telephone. A client 580 may enable a network player at client 580 to access network 580. A client 580 may enable its player to communicate with other players at other clients 580. Further, each client 580 may be a computing device, such as a desktop computer or a work station, or a mobile device, such as a notebook computer, a network computer, or a smart telephone.

In particular embodiments, a client 580 may have a web browser 582, such as Microsoft Internet Explorer, Google Chrome, Or Mozilla Firefox, and may have one or more add-ons, plug-ins, or other extensions. A player at client 580 may enter a Uniform Resource Locator (URL) or other address directing the web browser 582 to a server 570, and the web browser 582 may generate a Hyper Text Transfer Protocol (HTTP) request and communicate the HTTP request to server 570. Server 570 may accept the HTTP request and communicate to client 580 one or more Hyper Text Markup Language (HTML) files responsive to the HTTP request. Client 580 may render a web page based on the HTML files from server 570 for presentation to the user. The present disclosure contemplates any suitable web page files. As an example and not by way of limitation, web pages may render from HTML files, Extensible Hyper Text Markup Language (XHTML) files, or Extensible Markup Language (XML) files, according to particular needs. Such pages may also execute scripts such as, for example and without limitation, those written in Javascript, Java, Microsoft Silverlight, combinations of markup language and scripts such as AJAX (Asynchronous Javascript and XML), and the like. Herein, reference to a web page encompasses one or more corresponding web page files (which a browser may use to render the web page) and vice versa, where appropriate.

Web browser 582 may be adapted for the type of client 580 where the web browser executes. For example, a web browser residing on a desktop computer may differ (e.g., in functionalities) from a web browser residing on a mobile device. A user of a social networking system may access the website via web browser 582.

Figure 11:
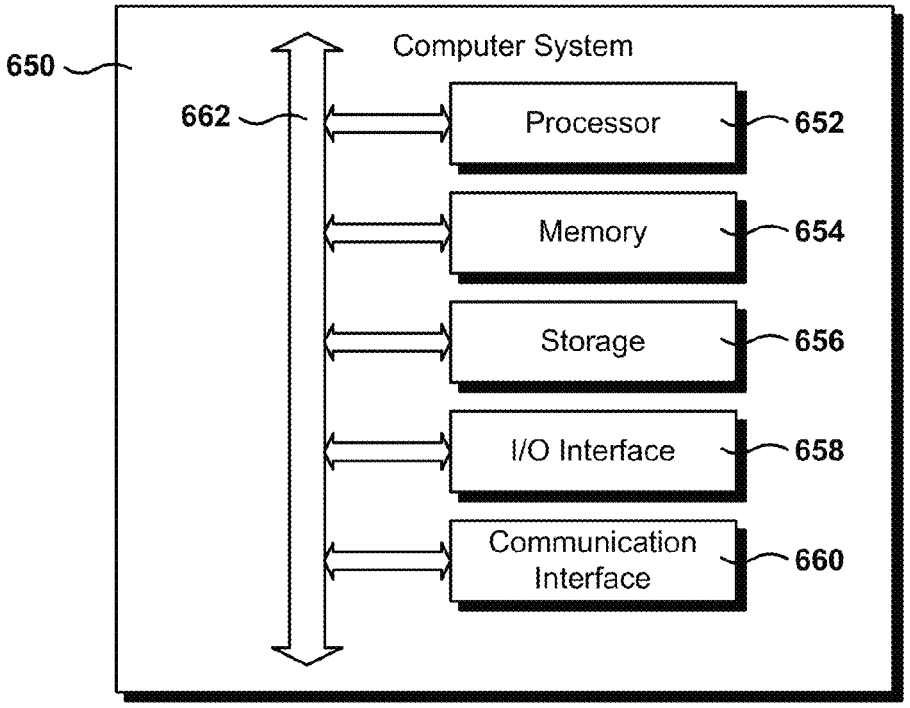
FIG. 11 illustrates an example computer system for implementing embodiments.

FIG. 11 illustrates an example computer system 650 for implementing embodiments. In particular embodiments, software running on one or more computer systems 650 performs one or more operations of one or more methods described or illustrated herein or provides functionality described or illustrated herein. Although methods for implementing embodiments were described with a particular sequence of operations, it is noted that the method operations may be performed in different order, or the timing for the execution of operations may be adjusted, or the operations may be performed in a distributed system by several entities, as long as the processing of the operations are performed in the desired way.

As example and not by way of limitation, computer system 650 may be an embedded computer system, a system-on-chip (SOC), a single-board computer system (SBC) (such as, for example, a computer-on-module (COM) or system-on-module (SOM)), a desktop computer system, a laptop or notebook computer system, an interactive kiosk, a mainframe, a mesh of computer systems, a mobile telephone, a personal digital assistant (PDA), a server, or a combination of two or more of these. Where appropriate, computer system 650 may include one or more computer systems 650; be stand-alone or distributed; span multiple locations; span multiple machines; or reside in a cloud, which may include one or more cloud components in one or more networks. The one or more computer systems 650 may perform in real time or in batch mode one or more operations of one or more methods described or illustrated herein.

In particular embodiments, computer system 650 includes a processor 652, memory 654, storage 656, an input/output (I/O) interface 658, a communication interface 660, and a bus 662. Although this disclosure describes and illustrates a particular computer system having a particular number of particular components in a particular arrangement, embodiments may be implemented with any suitable computer system having any suitable number of any suitable components in any suitable arrangement.

In particular embodiments, processor 652 includes hardware for executing instructions, such as those making up a computer program. As an example and not by way of limitation, to execute instructions, processor 652 may retrieve (or fetch) the instructions from an internal register, an internal cache, memory 654, or storage 656; decode and execute them; and then write one or more results to an internal register, an internal cache, memory 654, or storage 656. The present disclosure contemplates processor 652 including any suitable number of any suitable internal registers, where appropriate. Where appropriate, processor 652 may include one or more arithmetic logic units (ALUs); be a multi-core processor; or include one or more processors 652. Although this disclosure describes and illustrates a particular processor, this disclosure contemplates any suitable processor.

In particular embodiments, memory 654 includes main memory for storing instructions for processor 652 to execute, or data that can be manipulated by processor 652. As an example and not by way of limitation, computer system 650 may load instructions from storage 656 or another source (such as, for example, another computer system 650) to memory 654. Processor 652 may then load the instructions from memory 654 to an internal register or internal cache. During or after execution of the instructions, processor 652 may write one or more results (which may be intermediate or final results) to the internal register or internal cache. Processor 652 may then write one or more of those results to memory 654. One or more memory buses (which may each include an address bus and a data bus) may couple processor 652 to memory 654. Bus 662 may include one or more memory buses, as described below. One or more memory management units (MMUs) reside between processor 652 and memory 654 and facilitate accesses to memory 654 requested by processor 652. Memory 654 includes random access memory (RAM).

As an example and not by way of limitation, storage 656 may include a Hard Disk Drive (HDD), a floppy disk drive, flash memory, an optical disc, a magneto-optical disc, magnetic tape, or a Universal Serial Bus (USB) drive or a combination of two or more of these. Storage 656 may include removable or non-removable (or fixed) media, where appropriate. In particular embodiments, storage 656 includes read-only memory (ROM). Where appropriate, this ROM may be mask-programmed ROM, programmable ROM (PROM), erasable PROM (EPROM), electrically erasable PROM (EEPROM), electrically alterable ROM (EAROM), or flash memory or a combination of two or more of these.

In particular embodiments, I/O interface 658 includes hardware, software, or both providing one or more interfaces for communication between computer system 650 and one or more I/O devices. One or more of these I/O devices may enable communication between a person and computer system 650. As an example and not by way of limitation, an I/O device may include a keyboard, keypad, microphone, monitor, mouse, printer, scanner, speaker, still camera, stylus, tablet, touch screen, trackball, video camera, another suitable I/O device or a combination of two or more of these.

Communication interface 660 includes hardware, software, or both providing one or more interfaces for communication between computer system 650 and one or more other computer systems 650 on one or more networks. As an example and not by way of limitation, communication interface 660 may include a network interface controller (NIC) or network adapter for communicating with an Ethernet or other wire-based network or a wireless NIC (WNIC) or wireless adapter for communicating with a wireless network, such as a WI-FI network. As an example, computer system 650 may communicate with a wireless PAN (WPAN) (such as, for example, a BLUETOOTH WPAN), a WI-FI network, a WI-MAX network, a cellular telephone network (such as, for example, a Global System for Mobile Communications (GSM) network), or other suitable wireless network or a combination of two or more of these.

In particular embodiments, bus 662 includes hardware, software, or both coupling components of computer system 650 to each other. As an example and not by way of limitation, bus 662 may include an Accelerated Graphics Port (AGP) or other graphics bus, an Enhanced Industry Standard Architecture (EISA) bus, a front-side bus (FSB), a HYPERTRANSPORT (HT) interconnect, an Industry Standard Architecture (ISA) bus, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or another suitable bus or a combination of two or more of these. Bus 662 may include one or more buses 662, where appropriate.

Herein, reference to a computer-readable storage medium encompasses one or more non-transitory, tangible computer-readable storage media possessing structure that may store a computer program or data. As an example and not by way of limitation, a computer-readable storage medium may include a semiconductor-based or other integrated circuit (IC) (such, as for example, a field-programmable gate array (FPGA) or an application-specific IC (ASIC)), a hard disk, an HDD, a hybrid hard drive (HHD), an optical disc, an optical disc drive (ODD), a magneto-optical disc, a magneto-optical drive, a floppy disk, a floppy disk drive (FDD), magnetic tape, a holographic storage medium, a solid-state drive (SSD), a RAM-drive, a Secure Digital card, a Secure Digital drive, or another suitable computer-readable storage medium or a combination of two or more of these, where appropriate. Herein, reference to a computer-readable storage medium excludes any medium that is not eligible for patent protection under 35 U.S.C. §101.

One or more embodiments can also be fabricated as computer readable code on a non-transitory computer readable medium. Herein, reference to software may encompass one or more applications, bytecode, one or more computer programs, one or more executables, one or more instructions, logic, machine code, one or more scripts, or source code, and vice versa, where appropriate.

The present disclosure encompasses all changes, substitutions, variations, alterations, and modifications to the example embodiments herein that a person having ordinary skill in the art would comprehend.

What is claimed is:

1. A method implemented by a processor for executing a game, the method comprising:

receiving bets from players playing in a first gambling mode in an online gambling room;

determining contributions to a community metric based on outcomes of the bets in the first gambling mode, wherein all players in the online gambling room contribute towards the community metric as they play in the first gambling mode, wherein progress of the community metric is indicated by a community progress bar visible to the players, the community progress bar being a line bar that grows linearly as the community metric grows;

detecting when the community metric reaches a predetermined goal based on the contributions, wherein the predetermined goal is to fill the community progress bar;

entering all players in the online gambling room into a second gambling mode different from the first gambling mode when the predetermined goal is reached, wherein the second gambling mode includes a room goal, wherein all players contribute towards achieving the room goal based on outcomes of bets placed in the second gambling mode, wherein players do not compete against other players during the second gambling mode; and when the room goal is reached, ending the second gambling mode and returning all players to the first gambling mode, wherein a value of the community metric does not change while players are in the second gambling mode, wherein operations of the method are executed by a processor.

2. The method as recited in claim 1 further including:

applying rules for the first gambling mode and a degree of randomness to determine the outcomes of the bets.

3. The method as recited in claim 1, wherein the second gambling mode includes fighting an enemy that is common to all the players in the online gambling room, wherein fighting a common enemy includes inflicting damage in the common enemy based on the outcomes of the bets placed in the second gambling mode.

4. The method as recited in claim 1, wherein the second gambling mode includes fighting a common enemy, wherein damage inflicted in the common enemy is persistent and stored in memory after ending the second gambling mode, wherein the common enemy is defeated in a plurality of instances of the second gambling mode that are alternated with instances of the first gambling mode.

5. The method as recited in claim 1, wherein ending the second gambling mode further includes :

resetting a value of the community metric.

6. The method as recited in claim 1, wherein operations of the method are performed by a computer program when executed by one or more processors, the computer program being embedded in a non-transitory computer-readable storage medium.

7. The method as recited in claim 1, wherein a server executing the game sends periodic updates to client devices of players in the online gambling room, the periodic updates including information on a value of the community metric, wherein the server sends notifications to the client devices of players in the online gambling room when the second gambling mode is entered.

8. The method as recited in claim 7, wherein the server sends updates with a current value of the room goal to the client devices based on the contributions made by all players towards the room goal, wherein the server sends notifications to the client devices when the second gambling mode is ended.

9. The method as recited in claim 1, wherein the room goal is to inflict damage on a common enemy, where the damage is based on a multiplier associated with a number of players fighting the common enemy.

10. The method as recited in claim 1, further including:

obtaining social data of a first player from a social network via an application programming interface (API) defined by the social network, the social data including friends of the first player in the social network; and providing an option to the first player to invite the friends of the first player to participate in the second gambling mode.

11. The method as recited in claim 1, further including:

providing an option to the players to add one or more helper pets to assist in the second gambling mode by spending virtual currency to add the one or more helper pets.

12. A method implemented by a processor for executing a slots gambling game, the method comprising:

receiving bets from players playing slots in a first gambling mode in an online gambling room;

determining contributions to a community progress bar based on outcomes of the bets in the first gambling mode, wherein all players in the online gambling room contribute towards the community progress bar as they play in the first gambling mode, the community progress bar being a line bar that grows linearly based on contributions of the players;

detecting when the community progress bar reaches a predetermined goal based on the contributions, wherein the predetermined goal is to fill the community progress bar;

entering all players in the online gambling room into a second gambling mode different from the first gambling mode when the predetermined goal is reached, wherein the second gambling mode includes a room goal, wherein all players contribute towards achieving the room goal based on outcomes of bets placed in the second gambling mode, wherein players do not compete against other players during the second gambling mode; and when the room goal is reached, ending the second gambling mode and returning all players to the first gambling mode, wherein the second gambling mode includes different slots wheels from the slots wheels in the first gambling mode, wherein a value of the community progress bar does not change while players are in the second gambling mode, wherein operations of the method are executed by a processor.

13. The method as recited in claim 12, further including:

displaying to all the players a best player during the second gambling mode that contributes the most towards the room goal.

14. The method as recited in claim 13, wherein ending the second gambling mode further includes providing an option to all players for rewarding the best player.

15. The method as recited in claim 12, wherein the second gambling mode has a predetermined duration.

16. The method as recited in claim 12, wherein operations of the method are performed by a computer program when executed by one or more processors, the computer program being embedded in a non-transitory computer-readable storage medium.

17. The method as recited in claim 12, wherein a server executing the game sends periodic updates to client devices of players in the online gambling room, the periodic updates including information on a value of the community progress bar, wherein the server sends notifications to the client devices of players in the online gambling room when the second gambling mode is entered.

18. The method as recited in claim 17, wherein the server sends updates with a current value of the room goal to the client devices based on the contributions made by all players towards the room goal, wherein the server sends notifications to the client devices when the second gambling mode is ended.

19. A server comprising:

a processor; and a non-transitory memory in communication with the processor, the non-transitory memory including, program instructions for a game manager module operable to receive bets from players playing in a first gambling mode in an online gambling room, program instructions for a spin manager module operable to determine outcomes of the bets in the first gambling mode, and program instructions for a room manager operable to determine contributions to a community metric based on the outcomes of the bets, wherein all players in the online gambling room contribute towards the community metric, wherein progress of the community metric is indicated by a community progress bar visible to the players, the community progress bar being a line bar that grows linearly as the community metric grows, wherein the room manager is further operable to detect when the community metric reaches a predetermined goal, wherein the predetermined goal is to fill the community progress bar;

wherein all players in the online gambling room enter into a second gambling mode different from the first gambling mode when the predetermined goal is reached, wherein the second gambling mode includes a room goal, wherein all players contribute towards achieving the room goal based on outcomes of bets placed in the second gambling mode, wherein players do not compete against other players during the second gambling mode, wherein when the room goal is reached the second gambling mode is ended and all players returned to the first gambling mode, wherein a value of the community metric does not change while players are in the second gambling mode.

20. The server as recited in claim 19, wherein the online gambling is for a game selected from a group consisting of casino slots, roulette, blackjack, craps, or poker.

21. The server as recited in claim 19, wherein the gambling game is played in real-time.

22. The server as recited in claim 19, wherein the memory further includes:

design data defining rules for determining the outcomes.

23. The server as recited in claim 22, wherein the rules include one or more of odds of winning, maximum winnings, maximum bet, and frequency of winning.

24. The server as recited in claim 19, wherein the second gambling mode includes fighting a common enemy.

25. The server as recited in claim 19, wherein the server sends periodic updates to client devices of players in the online gambling room, the periodic updates including information on a value of the community metric, wherein the server sends notifications to the client devices of players in the online gambling room when the second gambling mode is entered.

26. The server as recited in claim 25, wherein the server sends updates with a current value of the room goal to the client devices based on the contributions made by all players towards the room goal, wherein the server sends notifications to the client devices when the second gambling mode is ended.

* * * * *